US010478676B2

(12) United States Patent
Saegusa et al.

(10) Patent No.: US 10,478,676 B2
(45) **Date of Patent: *Nov. 19, 2019**

(54) BALL FOR BALL GAME AND METHOD OF MANUFACTURING THE SAME

(71) Applicant: The Yokohama Rubber Co., LTD., Minato-ku, Tokyo (JP)

(72) Inventors: Hiroshi Saegusa, Hiratsuka (JP); Kumiko Shiota, Hiratsuka (JP)

(73) Assignee: The Yokohama Rubber Co., LTD. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/786,498

(22) Filed: Oct. 17, 2017

(65) Prior Publication Data

US 2018/0036603 A1 Feb. 8, 2018

Related U.S. Application Data

(62) Division of application No. 13/143,686, filed as application No. PCT/JP2010/007258 on Dec. 14, 2010, now Pat. No. 9,795,832.

(30) Foreign Application Priority Data

Dec. 14, 2009 (JP) ..... 2009-283380
Apr. 9, 2010 (JP) ..... 2010-090316

(51) Int. Cl.
*A63B 37/12* (2006.01)
*A63B 37/00* (2006.01)
(Continued)

(52) U.S. Cl.
CPC ..... *A63B 37/0096* (2013.01); *A63B 37/0004* (2013.01); *A63B 37/0005* (2013.01); *A63B 37/0006* (2013.01); *A63B 37/0012* (2013.01); *A63B 37/0056* (2013.01); *A63B 37/0074* (2013.01); *A63B 37/0075* (2013.01);
(Continued)

(58) Field of Classification Search
CPC . A63B 37/0004; A63B 37/0006; A63B 37/14; A63B 37/0005; A63B 37/0012; A63B 37/0056; A63B 37/0074; A63B 37/0075; A63B 37/0076; A63B 37/0088; A63B 37/0096; A63B 2220/16; A63B 43/004; A63B 45/00
USPC ..... 473/378, 379, 380, 381, 382, 383, 384, 473/385, 570
See application file for complete search history.

(56) References Cited

U.S. PATENT DOCUMENTS

2008/0000364 A1* 1/2008 Bevirt ..... A63B 24/0021 101/35

* cited by examiner

*Primary Examiner* — Vishu K Mendiratta
(74) *Attorney, Agent, or Firm* — Thorpe North & Western

(57) ABSTRACT

A golf ball including a spherical body, first regions, and second regions. The spherical body includes a core layer and a cover layer made from a synthetic resin covering the core layer. Dimples are formed in a surface of the cover layer. First regions that are electrically conductive are formed on a surface of the spherical body. The first regions are formed on a spherical surface having a center of the spherical body as a center. The first regions are positioned at six vertices of an imaginary regular hexahedron such that the vertices are positioned on the surface of the spherical body and, thus, six of the first regions are formed. The second regions are formed in areas of the surface other than where the first regions are formed. The second regions have a radio wave reflectance lower than that of the first regions.

12 Claims, 34 Drawing Sheets

(51) Int. Cl.

| | |
|---|---|
| ***A63B 37/14*** | (2006.01) |
| ***A63B 43/00*** | (2006.01) |
| ***A63B 45/00*** | (2006.01) |

(52) U.S. Cl.

CPC ..... *A63B 37/0076* (2013.01); *A63B 37/0088* (2013.01); *A63B 37/14* (2013.01); *A63B 43/004* (2013.01); *A63B 45/00* (2013.01); *A63B 2220/16* (2013.01); *A63B 2220/35* (2013.01)

| MEASUREMENT RESULTS | | | |
|---|---|---|---|
| Radio wave reflectance ratio | 1·times | 2·times | 4·times |
| Measuring time (sec) | 0.5 | 0.8 | 1.3 |
| Following distance (m) | 30 | 50 | 70 |

FIG. 8

| MEASUREMENT RESULTS | | |
|---|---|---|
| Radio wave reflectance ratio | 10·times | 15·times |
| Measuring time (sec) | 2 | 2.5 |
| Following distance (m) | 100 | 130 |

FIG. 9

| AMOUNT OF SPIN MEASUREMENT RESULTS | | | | |
|---|---|---|---|---|
| | | Comparative Example 1 | Comparative Example 2 | Working Example 1 |
| Number of first regions 22 | | 0 | 1 | 6 |
| Amount of spin | 1,000 rpm | 0% | 30% | 100% |
| | 3,000 rpm | 100% | 100% | 100% |

Number of golf balls: 10

| MEASUREMENT RESULTS | | | |
|---|---|---|---|
| | Comparative Example 3 | Comparative Example 4 | Working Example 2 |
| Number of first regions 22 | 0 | 1 | 6 |
| Measuring time (sec) | 0.5 | 1.25 | 2.6 |
| Following distance (m) | 30 | 75 | 156 |

FIG. 29

BALL FOR BALL GAME AND METHOD OF MANUFACTURING THE SAME

RELATED APPLICATIONS

This application is a divisional of U.S. application Ser. No. 13/143,686 filed on Jul. 7, 2011, which claims priority to International Patent Application No. PCT/JP2010/007258 filed on Dec. 14, 2010, which claims priority to Japanese Patent Application Nos. 2009-283380, filed on Dec. 14, 2009, and 2010-090316, filed on Apr. 9, 2010, each of which are incorporated herein by reference.

TECHNICAL FIELD

The present technology relates to a ball for a ball game and a method for manufacturing the same.

BACKGROUND ART

In recent years, apparatuses using a Doppler radar have been used to measure the trajectory and launching conditions of balls for ball games, and particularly for golf balls (initial velocity, launch angle, and amount of spin of golf balls).

With such apparatuses, a transmission wave consisting of microwaves is emitted from an antenna toward a golf ball and a reflection wave that is reflected from the golf ball is measured. Then, based on a Doppler signal obtained from the transmission wave and the reflection wave, the speed of travel and the amount of spin are calculated.

In these cases, the reflection wave must be obtained efficiently in order for the speed of travel and the amount of spin to be measured stably and reliably. In other words, efficiently obtaining the reflection wave is beneficial in measuring distance.

On the other hand, technology has been suggested for providing a layer or film including a metallic material throughout an entirety of a surface of a ball in order to enhance visual appearance and/or design.

Additionally, technology has been suggested for providing a metallic layer having a spherical surface shape between a core layer and a cover of a ball in order to ensure energy transfer.

SUMMARY OF THE TECHNOLOGY

According to the experiments conducted by the present inventors, while beneficial from the perspective of ensuring radio wave reflectivity, when a layer or film including a metallic material is formed throughout an entirety of a surface of a ball, an amount of spin of the ball is insufficient for ensuring measuring distance.

In light of the foregoing, an object of the present technology is to provide a ball for a ball game favorable for precisely and accurately measuring launching conditions and measuring trajectory, and a method of manufacturing the same.

In order to achieve the object described above, one aspect of the present technology is a ball for a ball game including a spherical body, first regions formed on a spherical surface having a center of the spherical body as a center, and second regions formed on the spherical surface in areas other than where the first regions are formed. A radio wave reflectance of the second regions is lower than a radio wave reflectance of the first regions.

Additionally, another aspect of the present technology is a method for manufacturing a ball for a ball game including a spherical body, first regions formed on a spherical surface having a center of the spherical body as a center, and second regions formed on the spherical surface in areas other than where the first regions are formed. A radio wave reflectance of the second regions is lower than a radio wave reflectance of the first regions. The method for manufacturing a ball for a ball game includes the steps of preparing a first material and a second material with a radio wave reflectance higher than that of the first material; forming the first material on the spherical surface having the center of the spherical body as a center; and forming the first regions by depositing the second material via vacuum deposition on the first material and forming the second regions formed from the first material by not depositing the second material in areas other than where the first regions are formed.

Another aspect of the present technology is a method for manufacturing a ball for a ball game including a spherical body, first regions formed on a spherical surface having a center of the spherical body as a center, and second regions formed on the spherical surface in areas other than where the first regions are formed. A radio wave reflectance of the second regions is lower than a radio wave reflectance of the first regions. The method for manufacturing a ball for a ball game includes the steps of preparing a first material and a second material with a radio wave reflectance higher than that of the first material; forming the spherical body from the first material; depositing the second material via vacuum deposition in all regions of the spherical surface having the center of the spherical body as a center, and removing the second material from a predetermined region after the depositing; forming the first regions from the second material remaining on the spherical surface, and forming the second regions from the spherical surface where the second material has been removed.

Another aspect of the present technology is a method for manufacturing a golf ball including a spherical body in which a multiplicity of dimples are formed on a spherical surface, first regions formed on the spherical surface, and second regions formed on the spherical surface in areas other than where the first regions are formed. A radio wave reflectance of the second regions is lower than a radio wave reflectance of the first regions. The method for manufacturing a golf ball includes the steps of preparing a first material and a second material with a radio wave reflectance higher than that of the first material; forming the spherical body from the first material; depositing the second material via vacuum deposition on all regions of the spherical surface including the multiplicity of dimples; removing the second material from the spherical surface by abrasing the spherical surface; forming the first regions from the second material remaining on the dimples; and forming the second regions from the spherical surface where the second material has been removed.

Another aspect of the present technology is a method for manufacturing a golf ball including a core layer having a surface that forms a spherical shape and in which a multiplicity of dimples are formed; a cover layer including a surface that includes a multiplicity of dimples, separate from said dimples, on the spherical surface, and that is made from a material that allows passage of radio waves and that covers the core layer; first regions formed on the surface of the core layer; and second regions formed on the surface of the core layer in areas other than where the first regions are formed. A radio wave reflectance of the second regions is lower than a radio wave reflectance of the first regions. The method for manufacturing a golf ball includes the steps of preparing a first material and a second material with a radio wave reflectance higher than that of the first material; forming the core layer from the first material; covering an entire region of the surface of the core layer with the second material; removing the second material from the spherical surface by abrasing the spherical surface of the core layer; forming the first regions from the second material remaining on the plurality of dimples of the core layer; forming the second regions from the spherical surface of the core layer where the second material has been removed; and thereafter forming the cover layer on an outer side of the core layer.

EFFECT OF THE TECHNOLOGY

According to the present technology, a transmission wave emitted from an antenna of a measuring device using a Doppler radar is reflected efficiently by a plurality of first regions that move with the rotation of a ball for a ball game. Therefore, signal intensity of a frequency distribution necessary for detecting an amount of spin in the Doppler signal can be ensured and the amount of spin can be detected stably and reliably, which is advantageous from the perspective of precisely and accurately measuring launching conditions and measuring trajectory.

Additionally, according to the manufacturing method of the present technology, a ball for a ball game or a golf ball can be obtained in which first regions formed by depositing a second material on a spherical surface of a spherical body and second regions are formed. Therefore, a large measuring distance with relation to the amount of spin of the ball for a ball game can be ensured, which is advantageous from the perspectives of simultaneously reducing production costs and ensuring product quality.

BRIEF DESCRIPTION OF THE DRAWINGS

FIG. 8 is a table showing a radio wave reflectance ratio, measuring time, and results of following distance experiments.

FIG. 9 is a table showing a radio wave reflectance ratio, measuring time, and results of following distance experiments.

FIG. 29 is a table showing a measuring time and a following distance of the amount of spin in Comparative Examples 3 and 4 and Working Example 2.

DETAILED DESCRIPTION

First Embodiment

Prior to describing the embodiments of the ball for a ball game of the present technology, a measuring apparatus for measuring launching conditions and measuring a trajectory of a ball for a ball game will be described.

Note that, the term "ball for a ball game" as used in the present technology includes balls used for competition, practice, amusement, and balls used for other purposes as well in ball games.

Figure 1:
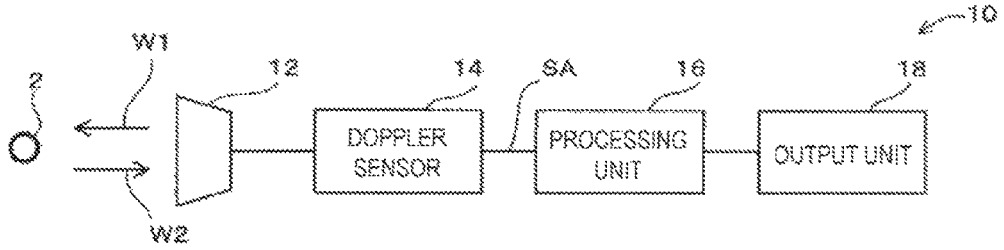
FIG. 1 is a block diagram illustrating a configuration of a measuring apparatus 10 using a Doppler radar for measuring launching conditions and/or measuring a trajectory of a ball for a ball game.

FIG. 1 is a block diagram illustrating a configuration of a measuring apparatus 10 using a Doppler radar for measuring launching conditions and/or measuring a trajectory of a ball for a ball game.

In this embodiment, a description will be given in which a golf ball is used as the ball for a ball game.

Additionally, a conventional measuring apparatus such as, for example, TrackMan™ (manufactured by TrackMan A/S) can be used as such a measuring apparatus 10.

Note that in this embodiment, for the sake of simplifying the description, a case in which the items measured by the measuring apparatus 10 are a speed of travel and an amount of spin of the golf ball will be described.

As illustrated in FIG. 1, the measuring apparatus 10 has a configuration including an antenna 12, a Doppler sensor 14, a processing unit 16, and an output unit 18.

Based on a transmission signal supplied from the Doppler sensor 14, the antenna 12 transmits a transmission wave W1 (microwaves) toward a golf ball 2, receives a reflection wave W2 reflected by the golf ball 2, and supplies the received signal to the Doppler sensor 14.

Note that the golf ball 2 is launched by being struck by a golf club, or, alternatively, is launched by a dedicated golf ball launching apparatus (launcher).

The Doppler sensor 14 detects a Doppler signal Sd by supplying the transmission signal to the antenna 12 and receiving the received signal supplied from the antenna 12.

The "Doppler signal" is a signal having a Doppler frequency Fd defined by a frequency F1-F2, which is a difference between a frequency F1 of the transmission signal and a frequency F2 of the received signal.

Examples of the transmission signal include 24 GHz or 10 GHz microwaves.

The processing unit 16 measures the speed of travel and the amount of spin of the golf ball 2 based on the Doppler signal Sd supplied from the Doppler sensor 14.

The output unit 18 outputs the measured value measured by the processing unit 16.

Specifically, the output unit 18 display-outputs the measured value using a display device such as a liquid crystal panel, or, alternatively, print-outputs the measured value using a printer.

Additionally, the output unit 18 may supply the measured value to an external device such as a personal computer or the like.

Next, the measuring of the velocity and the amount of spin of the golf ball 2 will be described.

As known conventionally, the Doppler frequency Fd is expressed by Formula (1).

$$Fd=F1-F2=V\cdot 2\cdot F1/c \quad (1)$$

V is the velocity of the golf ball 2, and c is the speed of light ($3\cdot 10^8$ m/s)

Thus, when Formula (1) is solved for V, Formula (2) is arrived at.

$$V=c\cdot Fd/F1 \quad (2)$$

In other words, a velocity V of the golf ball 2 is proportional to the Doppler frequency Fd.

Thus, the Doppler frequency Fd can be detected from the Doppler signal Sd and the velocity V can be calculated from the Doppler frequency Fd.

Figure 2:
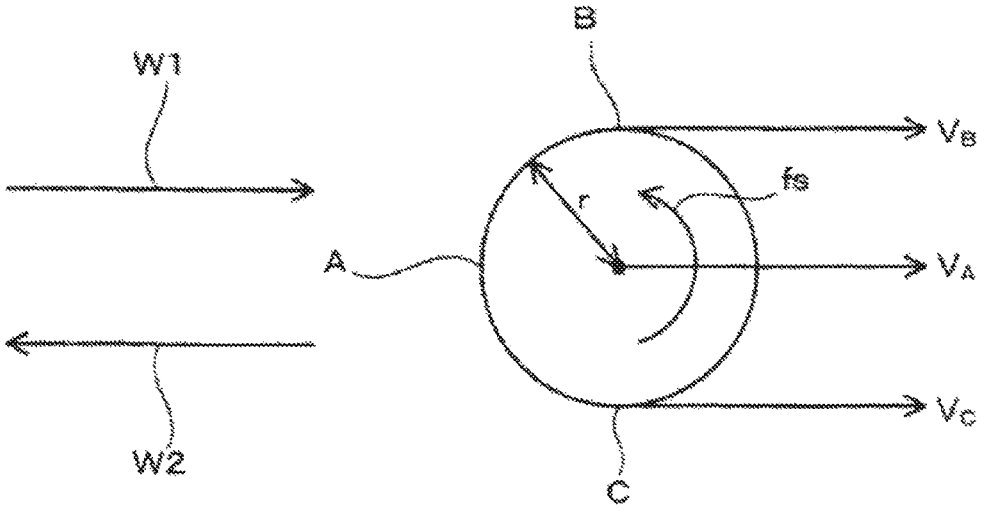
FIG. 2 is an explanatory drawing illustrating the principle for detecting an amount of spin of a golf ball 2.

FIG. 2 is an explanatory drawing illustrating the principle for detecting an amount of spin of a golf ball 2.

The transmission wave W1 reflects efficiently at a first portion A of a surface of the golf ball 2, which is a portion of the surface where an angle formed with a transmission direction of the transmission wave W1 is close to 90 degrees. Thus, an intensity of the reflection wave W2 at the first portion A is high.

On the other hand, the transmission wave W1 does not reflect efficiently at a second portion B and a third portion C of a surface of the golf ball 2, which are portions of the surface where the angle formed with the transmission direction of the transmission wave W1 is close to 0 degrees. Thus, an intensity of the reflection wave W2 at the second portion B and the third portion C is low.

The second portion B is a portion where a direction of spin movement of the golf ball 2 and a movement direction of the golf ball 2 are opposite.

The third portion C is a portion where a direction of spin movement of the golf ball 2 and a movement direction of the golf ball 2 are the same.

When a first velocity VA is a velocity detected based on the reflection wave W2 reflected at the first portion A, a second velocity VB is a velocity detected based on the reflection wave W2 reflected at the second portion B, and a third velocity VC is a velocity detected based on the reflection wave W2 reflected at the third portion C, the following formulas are achieved:

$$VA=V \quad (1)$$

$$VB=VA-\omega r \quad (2)$$

$$VC=VA+\omega r \quad (3)$$

V is the speed of travel of the golf ball, ω is an angular velocity (rad/s), and r is a radius of the golf ball 2.

Thus, if the first, second, and third velocities V1, V2, and V3 can be measured, the speed of travel V of the golf ball 2 can be calculated from the first velocity VA based on Formula (1). Additionally, since the angular velocity ω can be calculated from the second and third velocities V2 and V3 based on Formulas (2) and (3), the amount of spin can be calculated from the angular velocity ω.

Next, the measurement of the first, second, and third velocities V1, V2, and V3 is described.

Figure 3:
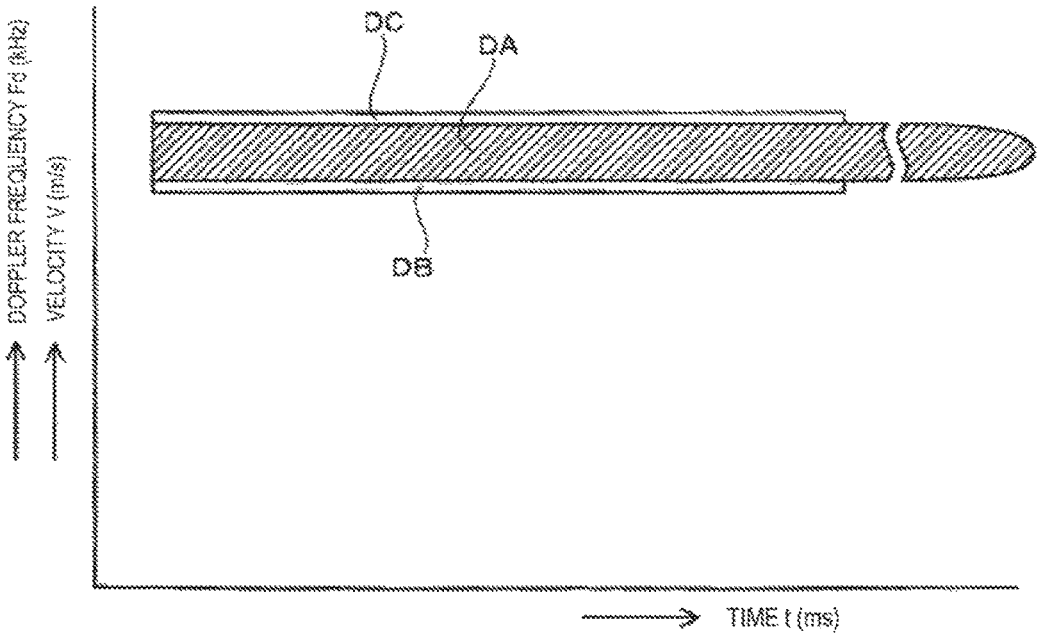
FIG. 3 is a chart showing the results of a wavelet analysis of a Doppler signal Sd for a case in which the golf ball 2 launched by a golf ball launching apparatus was measured by the measuring apparatus 10.

FIG. 3 is a chart showing the results of a wavelet analysis of a Doppler signal Sd for a case in which the golf ball 2 launched by a golf ball launching apparatus was measured by the measuring apparatus 10.

Time t (ms) is shown on the horizontal axis and the Doppler frequency Fd (kHz) and the velocity V (m/s) of the golf ball 2 are shown on the vertical axis.

Such a line chart is obtained by, for example, sampling and capturing the Doppler signal Sd in a digital oscilloscope, converting the Doppler signal Sd to digital data, and using a personal computer or the like to perform a wavelet analysis or an FFT analysis.

In the frequency distribution shown in FIG. 3, an intensity of the Doppler signal Sd is high in the portion illustrated using cross-hatching, and the intensity of the Doppler signal Sd in the portion illustrated using solid lines is lower than that of the portion illustrated using the cross-hatching.

Thus, signal intensity of the frequency distribution at the area labeled DA, a portion corresponding to the first velocity VA, is high.

Signal intensity of the frequency distribution at the area labeled DB, a portion corresponding to the second velocity VB, is low.

Signal intensity of the frequency distribution at the area labeled DC, a portion corresponding to the third velocity VC, is low.

Thus, by performing an analysis of the intensity of the Doppler signal Sd based on frequency, the frequency distributions DA, DB, and DC, are identified, and the first, second, and third velocities VA, VB, and VC can be obtained from the frequency distributions DA, DB, and DC, respectively, as time series data by using the principles of the Formulas (1), (2), and (3) described above.

Such processing is possible using one of various conventional signal processing circuits, or, alternatively, a microprocessor that operates based on a signal processing program.

When calculating the amount of spin of the golf ball 2, it is necessary to measure the second and third velocities VA and VC stably and reliably and, therefore, it is necessary to measure the Doppler signal Sd stably and reliably.

However, the farther a launched golf ball 2 is from the antenna 12 (the more time has passed), the lower the signal intensity of the reflection wave W2 received by the antenna 12 will be, and the lower the signal intensity of each of the frequency distributions DA, DB, and DC will be.

Here, in the first place, the signal intensity of the frequency distributions DB and DC of the Doppler signal Sd are weaker than the signal intensity of the frequency distribution DA.

Therefore, there is a disadvantage from the perspective of measuring the second and third velocities V2 and V3 stably. Since the signal intensity receivable by the antenna 12 declines in a shorter period of time than that of the frequency distribution DA, the measurable time of the second and third velocities V2 and V3 is extremely limited, and thus is disadvantageous.

For example, even if the measuring apparatus 10 is a complex apparatus that analyzes the trajectory of a golf ball and an output of the transmission wave W1 is high, the period of time during which the second and third velocities V2 and V3 can be measured is limited to no more than about two seconds from a point of launching the golf ball 2.

Additionally, in cases where the measuring apparatus 10 is applied to an indoor golf simulator, the output of the transmission wave W1 will be low. Therefore, it will be difficult to obtain frequency distributions DB and DC that have sufficient signal intensity.

As a result, with golf simulators, the current situation is limited to calculating trajectory and carrying distance based on an initial velocity and launching angle of the golf ball, and simulations that provide a higher degree of accuracy that take into account the amount of spin are desired.

Next, the golf ball of the present technology will be described.

Figure 4:
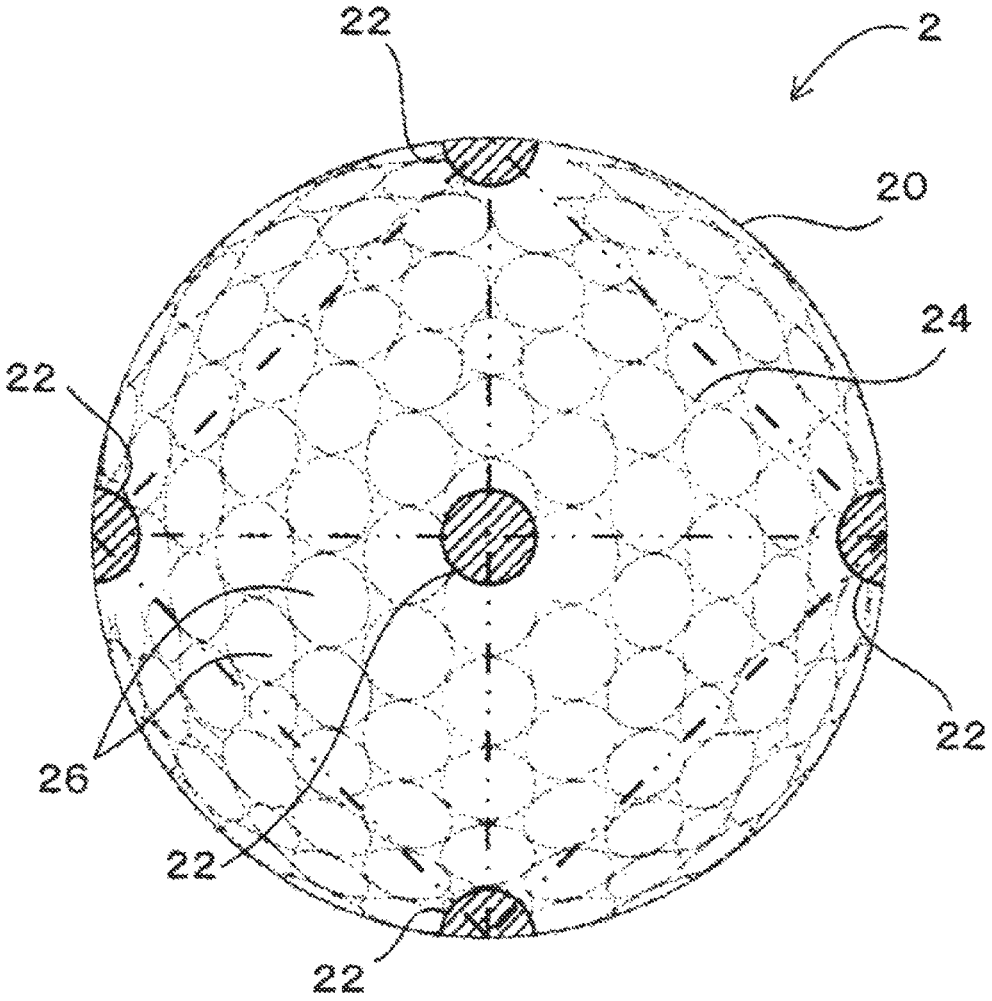
FIG. 4 is a plan view of the golf ball 2 according to a first embodiment.

FIG. 4 is a plan view of the golf ball 2 according to a first embodiment.

As illustrated in FIG. 4, the golf ball 2 includes a spherical body 20, first regions 22, and second regions 24.

The spherical body 20 is formed from a solid, spherical core layer and a cover layer made from a synthetic resin covering the core layer. A multiplicity of dimples 26 are formed in a surface of the cover layer.

The first regions 22 are formed on a spherical surface having a center of the spherical body 20 as a center, and the second regions 24 are formed on the spherical surface in areas other than where the first regions 22 are formed. A radio wave reflectance of the second regions 24 is lower than a radio wave reflectance of the first regions 22.

In this case, the spherical surface having a center of the spherical body 20 as a center is a surface of the golf ball 2, and the surface of the golf ball 2 is constituted by a spherical surface in which the multiplicity of dimples 26 are formed.

In other words, the first regions 22 are regions having high radio wave reflectance that are formed on the spherical surface having a center of the spherical body 20 as a center.

Thus, the first regions 22 have high radio wave reflectance characteristics and efficiently reflect radio waves (microwaves).

In this embodiment, a plurality of the first regions 22 that are electrically conductive is formed on a surface of the spherical body 20 (on the surface of the cover layer).

Additionally, each of the first regions 22 is circular in shape and has the same diameter, but the shape of each of the first regions 22 may be triangular, rectangular, regular polygonal, or the like.

When each of the first regions 22 is circular, from the perspectives of ensuring intensity of a reflection wave and ensuring measuring precision of the measuring apparatus 10, a diameter of the circle is preferably not less than 2 mm and not more than 15 mm.

Additionally, when each of the first regions 22 is regular polygonal, from the perspectives of ensuring intensity of the reflection wave and ensuring measuring precision of the measuring apparatus 10, a diameter of an inscribed circle is preferably not less than 2 mm and not more than 15 mm.

Note that it has been confirmed by the results of experiments performed by the present inventors in which 24 GHz and 10 GHz microwaves were used as the transmission wave that it is advantageous from the perspective of ensuring measuring precision that the diameter of the circle or the inscribed circle be not less than 2 mm and not more than 15 mm. A cause of this is considered to be, for example, because interference between a reflection wave reflected by a surface of the first regions 22 and a reflection wave reflected by an edge portion of the first regions 22 on measuring precision is reduced.

Figure 5:
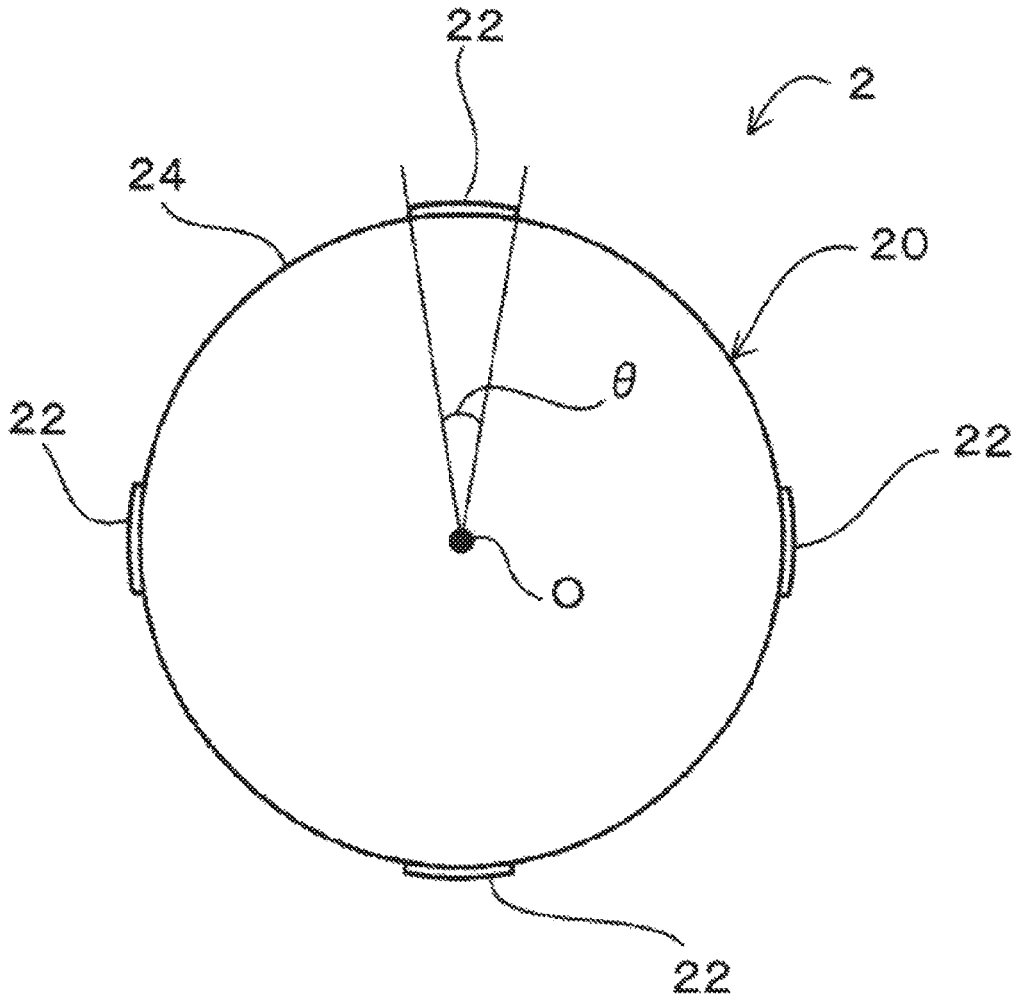
FIG. 5 is a cross-sectional view of the golf ball 2 describing a size of first regions 22.

Additionally, as illustrated in FIG. 5, on the spherical surface (in this embodiment, on the surface of the spherical body 20), from the perspectives of obtaining a reflection wave of sufficient intensity and receiving a reflection wave with excellent precision, an angle θ formed by two lines passing through two mutually opposing positions of the first regions 22 and through a center O of the spherical body 20 is preferably not less than 5 degrees and not more than 45 degrees.

The plurality of first regions 22 is positioned at vertices of an imaginary regular polyhedron or a semiregular polyhedron such that the vertices are positioned on the surface of the spherical body 20 (spherical surface having a center of the spherical body 20 as a center).

For example, in this embodiment, the first regions 22 are positioned at the six vertices of an imaginary regular hexahedron such that the vertices are positioned on the surface of the spherical body 20. Thus, six of the first regions 22 are formed.

Figure 6:
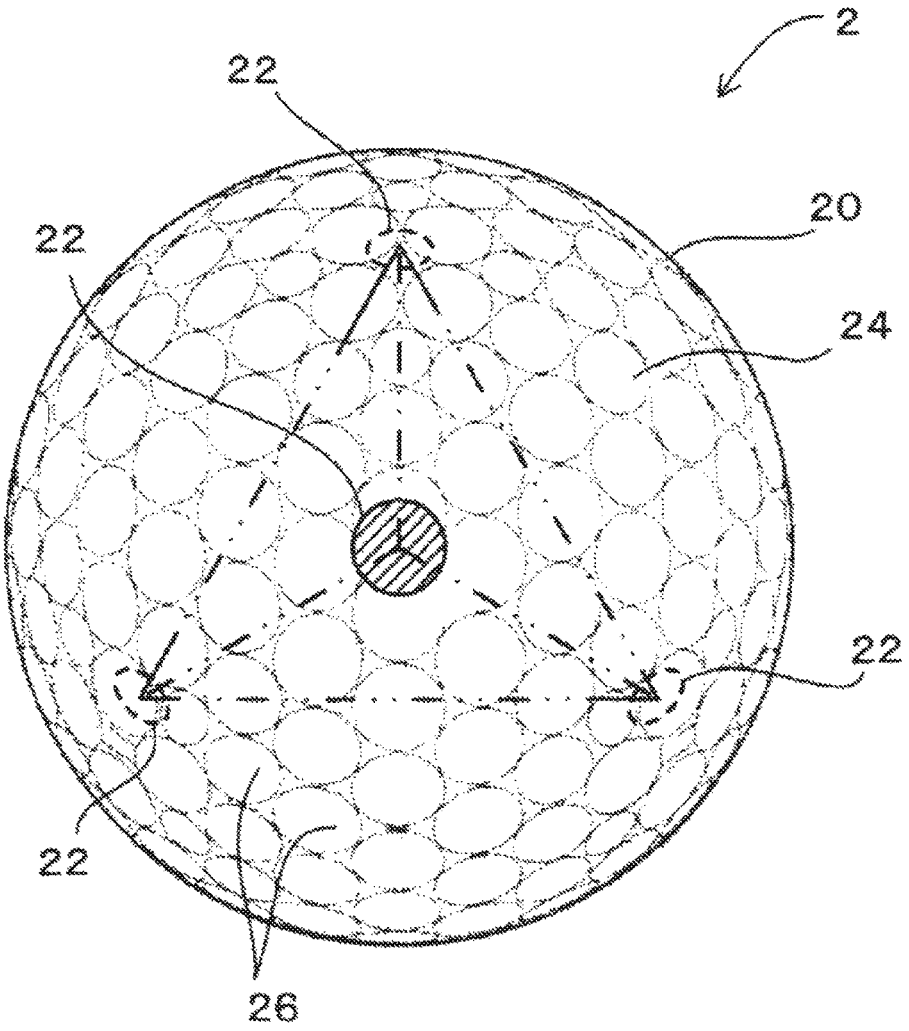
FIG. 6 is a plan view of the golf ball 2 according to a first modified example.

Additionally, in a first modified example illustrated in FIG. 6, the first regions 22 are positioned at the four vertices of an imaginary regular tetrahedron such that the vertices are positioned on the surface of the spherical body 20. Thus, four of the first regions 22 are formed.

Figure 7:
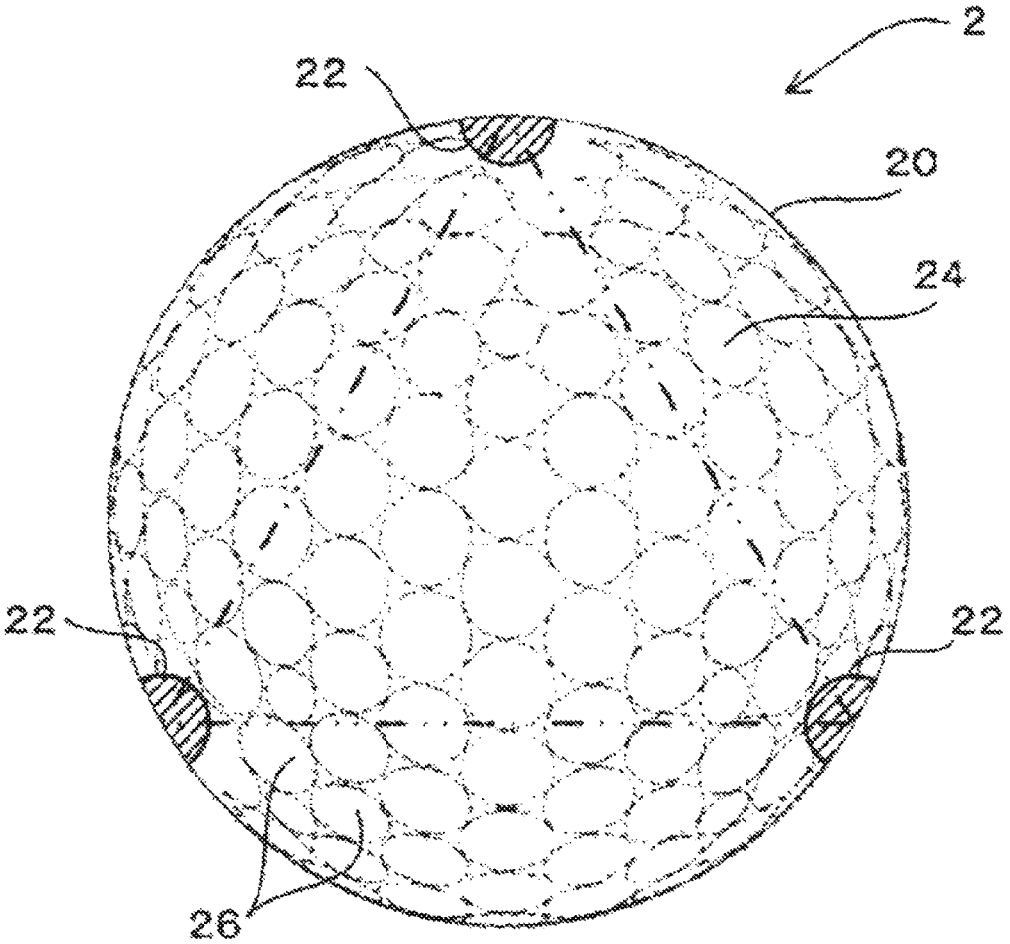
FIG. 7 is a plan view of the golf ball 2 according to a second modified example.

Alternatively, as illustrated in a second modified example illustrated in FIG. 7, three of the first regions 22 may be formed where imaginary lines connecting the three first regions 22 form an equilateral triangle including a diameter of the spherical body 20 on a plane.

In summary, a plurality of the first regions 22 may be formed on the surface of the spherical body 20, and the number of the first regions 22 may be set as desired.

However, regardless of the direction a rotational axis of the spherical body 20 is oriented, from the perspective of obtaining a stable reflection wave W2, it is preferable that as many of the first regions 22 as possible reflect the transmission wave W1 while moving (while rotating).

FIGS. 4, 6, and 7 will be compared from this perspective.

In a case where six of the first regions 22 are formed such as in FIG. 4, when two of the first regions 22 are positioned on the rotational axis, four radio wave regions 22 that reflect an effective reflection wave W2 are obtained.

In a case where four of the first regions 22 are formed such as in FIG. 6, when one of the first regions 22 is positioned on the rotational axis, three radio wave regions 22 that reflect an effective reflection wave W2 are obtained.

In a case where three of the first regions 22 are formed such as in FIG. 7, when one of the first regions 22 is positioned on the rotational axis, two radio wave regions 22 that reflect an effective reflection wave W2 are obtained.

Thus, from the perspective of obtaining a stable reflection wave W2, FIG. 6 is advantageous over FIG. 7 and FIG. 4 is advantageous over FIG. 6.

Additionally, each of the plurality of first regions 22 extends in a linear manner, mutually orthogonal, on the surface of the spherical body 20, thereby forming a honeycomb-shape.

In this case, the second regions 24 are partitioned in a rectangular shape by the first regions 22 that extend in a linear manner.

It is sufficient that the first regions 22 be able to ensure a sufficient intensity of the reflection wave W2. For example, by applying a conventional relational expression given below, a necessary range can be calculated as a surface resistance of the first regions 22.

Specifically, when Γ is radio wave reflectance and R is surface resistance the following formulas (1) and (2) are achieved:

$$\Gamma=(377-R)/(377+R) \quad (1)$$

$$R=(377(1-\Gamma))/(1+\Gamma) \quad (2)$$

δ=1 indicates complete reflectance, Γ=0 indicates zero reflectance, and 377 indicates the characteristic impedance of the air.

Thus, from Formula (2):

when Γ=1, R=0; and when Γ=0, R=377.

Here, when Γ=0.5, R=377(0.5/1.5)≈130.

Thus, when a value sufficient as the radio wave reflectance Γ is set to not less than Γ=0.5 (50%), the surface resistance R must be not more than 130 Ω/sq.

Additionally, from the perspective of ensuring the intensity of the reflection wave W2, preferably the radio wave reflectance Γ is not less than 0.9 (90%) and the surface resistance R is not more than 20 Ω/sq.

Note that the radio wave reflectance Γ can be measured using a conventional method such as a waveguide method, a free space method, or the like.

An electrically conductive material can be used as a material constituting the first regions 22.

Examples of the electrically conductive material include electrically conductive coating materials containing a metal powder. The first regions 22 are formed by applying (printing) such an electrically conductive coating material on the surface of the spherical body 20.

Examples of such a coating material that can be used include various conventional coating materials such as anti-rust coating materials including zinc.

Additionally, the electrically conductive material may be a metal foil. The first regions 22 are formed by affixing such a metal foil to the surface of the spherical body 20 using an adhesive.

Examples of such a metal foil that can be used include various conventional metal foils such as aluminum foil and the like.

Additionally, the first regions 22 may be formed by a deposited film of a discontinuous deposited film formed by depositing the electrically conductive material.

Note that the discontinuous deposited film is formed through discontinuous deposition performed in a vacuum. A discontinuous deposited film is a deposited film in a state where atoms vaporized from a target are deposited on the surface of the spherical body 20 (non-deposition body) and the deposition is stopped at a stage during the process of growth of a plurality of growth sites when each of the growth sites is not in contact with each other or, in other words, when each of the growth sites is not continuous so that the growth sites are in a state of electrical non-conductivity.

Thus, in the discontinuous deposited film, while electrical conductivity does not exist between the growth sites and a non-conducting body is formed, the growth sites have radio wave reflectability.

Additionally, examples of a metal that can be used for forming the metal powder, metal foil, or deposited film described above include various conventional metals such as silver, copper, gold, nickel, aluminum, iron, titanium, tungsten, and the like.

Note that examples of the electrically conductive material that can be used include electrically conductive materials other than metals such as various conventional materials containing carbon and the like.

The second regions 24 are formed on the spherical surface in areas other than where the first regions 22 are formed and a radio wave reflectance thereof is lower than that of the first regions 22.

In other words, the second regions 24 have lower radio wave reflectance than the first regions 22.

In this embodiment, the second regions 24 are formed on the areas of the surface other than where the first regions 22 are formed (the remaining areas of the surface of the cover layer where the first regions 22 are not formed) and are not electrically conductive.

In this embodiment, the second regions 24 are formed by the synthetic resin that forms the surface of the golf ball 2.

When using a conventional measuring apparatus such as, for example, TrackMan™ (manufactured by TrackMan A/S) as such a measuring apparatus 10, setting a ratio (difference) between the radio wave reflectance of the first regions 22 and the radio wave reflectance of the second regions 24 to be large will be advantageous from the perspectives of more accurately detecting the amount of spin and detecting the amount of spin over an extended period of time.

In this case, from the perspective of ensuring a large ratio (difference) between the radio wave reflectance of the first regions 22 and the radio wave reflectance of the second regions 24 it is advantageous to set the radio wave reflectance of the second regions 24 to be not more than 5% and the surface resistance to be not less than 340 Ω/sq.

Additionally, as shown in FIG. 8, if the radio wave reflectance of the first regions 22 is set to be not less than twice the radio wave reflectance of the second regions 24, the measuring time and the following distance of the amount of spin can be increased, and therefore this is advantageous from the perspective of detecting the amount of spin over an extended period of time.

Additionally, as shown in FIG. 9, if the radio wave reflectance of the first regions 22 is set to be not less than ten-times the radio wave reflectance of the second regions 24, the measuring time and the following distance of the amount of spin can be further increased, and therefore this is advantageous from the perspective of detecting the amount of spin over a period of time further extended.

Note that FIGS. 8 and 9 were obtained by performing experiments on the golf ball 2 of the first embodiment.

The golf ball 2 has six of the first regions 22 and is configured as illustrated in FIG. 4. Note that in FIG. 8, a golf ball 2 having a radio wave reflectance ratio of one-times is included as a Comparative Example. In this Comparative Example, the radio wave reflectance of the first region and the radio wave reflectance of the second region are equivalent or, in other words, correspond to a state in which the first region is not provided. The Comparative Example is disadvantageous from the perspective of detecting the amount of spin over an extended period of time because the measuring time and the following distance of the amount of spin are short.

The amount of spin of the golf balls 2 with the passage of time was obtained by launching each of the golf balls 2 having the configuration described above using a golf ball launcher and measuring using the measuring apparatus 10.

The initial velocity imparted to the golf ball 2 by the golf ball launcher was set to be 60 m/s and the amount of spin imparted to the golf ball 2 to be 3,000 rpm.

The number of each of the golf balls 2 measured was ten.

FIGS. 8 and 9 show average values of the measuring time and the following distance of the amount of spin for the measurements performed for the ten golf balls 2.

Note that a total area of the first regions 22 is preferably not more than 50% and more preferably from 2% to 30% of a surface area of the spherical body 20.

It is advantageous that the total area of the first regions 22 is not more than 50% of the surface area of the spherical body 20 from the perspective of ensuring a large ratio (difference) between a reflection intensity of the radio waves reflected by the first regions 22 and a reflection intensity of the radio waves reflected by the second regions 24; and it is advantageous that the total area of the first regions 22 is from 2% to 30% from the perspective of ensuring a large ratio (difference) between the reflection intensities described above.

It is advantageous that a large ratio (difference) between the reflection intensities at the first regions 22 and the second regions 24 be ensured from the perspective of stably measuring the amount of spin.

In this embodiment, all regions of the first regions 22 and the second regions 24 are covered with a film made of synthetic resin such as, for example, a transparent film made of synthetic resin.

As a result of such a configuration, the first regions 22 are protected by the film made of synthetic resin. This is advantageous from the perspectives of suppressing peeling of the first regions 22 when the golf ball 2 is hit by a golf club head and enhancing durability.

Figure 10:
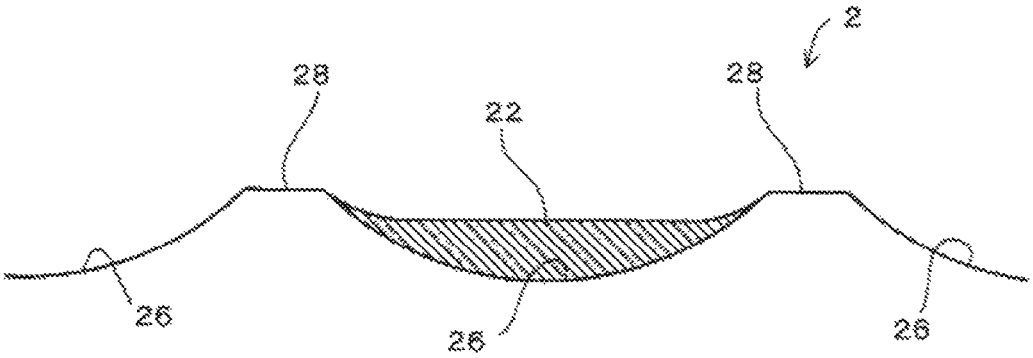
FIG. 10 is a cross-sectional view illustrating a dimple 26 of the golf ball 2.

Additionally, as illustrated in FIG. 10, the first regions 22 may be formed on dimples 26 formed in the surface (the spherical surface) of the golf ball 2. In this case, the second regions 24 are formed in the surface (the spherical surface other than the dimples 26) of the golf ball 2 other than where the dimples 26 are formed.

As a result of such a configuration, the first regions 22 are protected by protrusions (ridges) that protrude from the dimples 26. As described previously, this is advantageous from the perspectives of suppressing peeling of the first regions 22 and enhancing durability. Additionally, such a configuration is advantageous compared with a case in which all regions of the first regions 22 and the second regions 24 are covered with a synthetic resin from the perspectives of reducing materials and production man-hours and lowering costs.

Next, the effects of the golf ball 2 of this embodiment will be described.

The golf ball 2 of this embodiment includes the first regions 22 formed on the spherical surface having the center of the spherical body 20 as a center, and the second regions 24 formed on the spherical surface in areas other than where the first regions 22 are formed. A radio wave reflectance of the second regions 24 is lower than a radio wave reflectance of the first regions 22.

Thus, the transmission wave W1 emitted from the antenna 12 of the measuring apparatus 10 is reflected from the plurality of first regions 22 that move in accordance with the rotation of the golf ball 2. This is advantageous from the perspective of ensuring the radio wave intensity of the reflection wave W2.

Therefore, even if the signal intensity of the reflection wave W2 received by the antenna 12 declines due to the distance between the hit golf ball 2 and the antenna increasing, the signal intensity of each of the frequency distributions DA, DB, and DC can be ensured.

Particularly, signal intensities of the frequency distributions DB and DC, which are weaker than the signal intensity of the frequency distribution DA in the first place, can be ensured, which is advantageous from the perspective of stably measuring the second and third velocities V2 and V3.

In other words, signal intensity of the frequency distributions necessary to detect the amount of spin included in a Doppler signal can be ensured, which is advantageous from the perspective of stably and reliably detecting the amount of spin.

Thus, the amount of spin can be stably measured over a longer period of time due to being able to measure the second and third velocities V2 and V3 over a longer period of time.

Additionally, in cases where the measuring apparatus 10 is applied to an indoor golf simulator, even if the output of the transmission wave W1 is low and a sufficient S/N ratio cannot be obtained, the frequency distributions DB and DC having sufficient signal intensities can be obtained.

As a result, with golf simulators, trajectory and carrying distance can be calculated based on the amount of spin as well as the initial velocity and launching angle of the golf ball, and simulations that provide a higher degree of accuracy that take into account the amount of spin can be performed.

Specifically, by introducing the amount of spin into the calculation, simulations that have been impossible such as simulations of the returning trajectory of a fade line or a draw line with respect to a target line can be performed. Additionally, by introducing the amount of spin, carrying distance can be simulated with a higher degree of accuracy.

Second Embodiment

Next, a second embodiment with be described.

Figure 11:
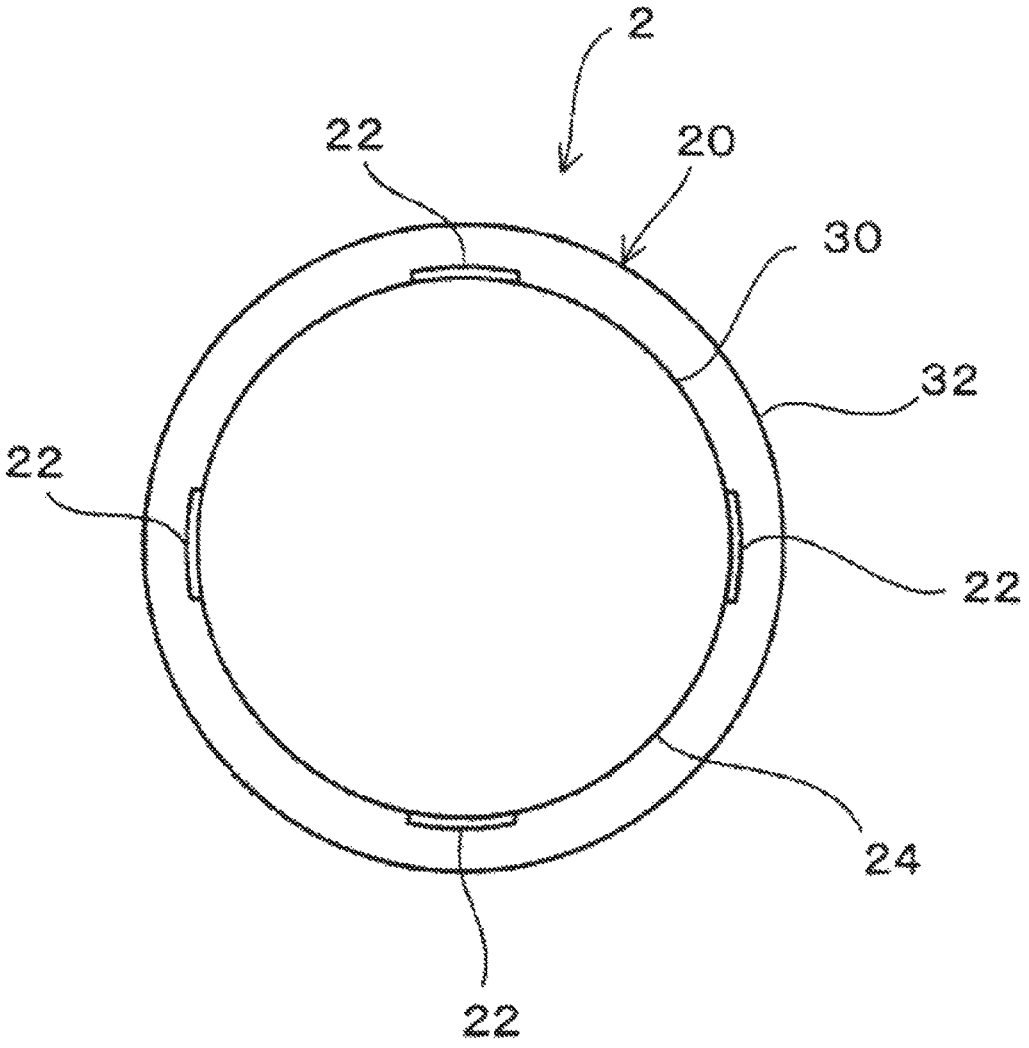
FIG. 11 is a cross-sectional view of a golf ball 2 according to a second embodiment.

FIG. 11 is a cross-sectional view of a golf ball 2 according to a second embodiment. In this embodiment, elements identical to those of the first embodiment are assigned identical reference numerals, and detailed descriptions thereof are omitted.

As illustrated in FIG. 11, a golf ball 2 includes a spherical body 20, and the spherical body 20 is formed by a spherical, solid core layer 30 and a cover layer 32 covering the core layer 30.

The core layer 30 includes a plurality of electrically conductive first regions 22 formed on a surface of the core layer 30 and non-electrically conductive second regions 24 formed in areas of the surface of the core layer 30 other than where the first regions are formed.

Specifically, the first regions 22 are formed on a spherical surface having a center of the spherical body 20 as a center, and the second regions 24 are formed on the spherical surface having a center of the spherical body 20 as a center in areas other than where the first regions 22 are formed.

A configuration of the first regions 22 and the second regions 24 is the same as the configuration of the first regions 22 and the second regions 24 of the first embodiment.

In this embodiment, the cover layer 32 is formed from a material that allows passage of radio waves such as, for example, a material that does not contain an electrically conductive substance so that radio waves will be reflected from the first regions 22. Examples of such a material that can be used include various conventional synthetic resins and the like.

A multiplicity of dimples is formed in a surface of the cover layer 32.

In this case, if the cover layer 32 is configured so as to be opaque, the first regions 22 and the second regions 24 can be hidden from a viewer, which is advantageous from the perspective of enhancing design.

Additionally, a thickness of the cover layer 32 is preferably not less than 0.5 mm and not more than 3.0 mm and more preferably not less than 1.0 mm and not more than 2.0 mm.

It is advantageous that the thickness of the cover layer 32 is not less than 0.5 mm and not more than 3.0 mm from the perspective of ensuring durability while ensuring a large radio wave reflectability.

It is advantageous that the thickness of the cover layer 32 is not less than 1.0 mm and not more than 2.0 mm from the perspectives of ensuring durability while ensuring a large radio wave reflectability and also simplifying manufacturing.

According to the second embodiment, the core layer 30 is covered by the cover layer 32 formed from the material that allows the passage of radio waves, the plurality of electrically conductive first regions 22 is formed on the surface of the core layer 30, and the non-electrically conductive second regions 24 are formed in areas of the surface of the core layer 30 other than where the first regions 22 are formed.

Thus, the transmission wave W1 emitted from the antenna 12 of the measuring apparatus 10 is reflected from the plurality of first regions 22 that move in accordance with the rotation of the golf ball 2. This is advantageous from the perspective of ensuring the radio wave intensity of the reflection wave W2 and, therefore, the same effects as provided by the first embodiment are provided.

Additionally, the first regions 22 are protected by the cover layer 32. This is advantageous from the perspectives of suppressing peeling of the first regions 22 when the golf ball 2 is hit by a golf club head and enhancing durability.

Third Embodiment

Next, a third embodiment with be described.

Figure 12:
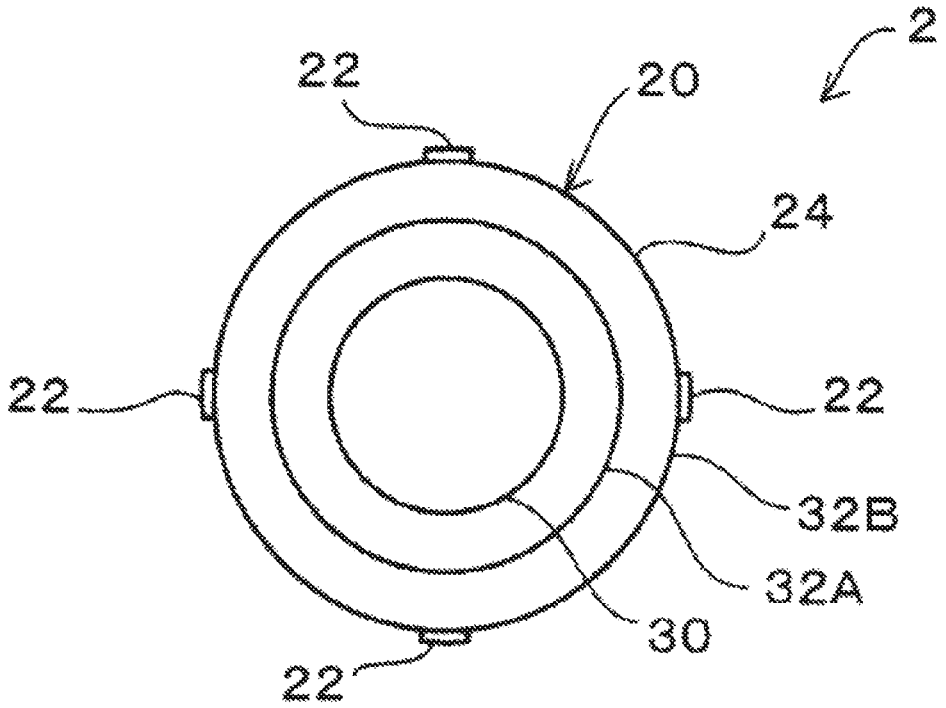
FIG. 12 is a cross-sectional view of a golf ball 2 according to a third embodiment.

FIG. 12 is a cross-sectional view of a golf ball 2 according to a third embodiment.

The third embodiment is a modified example of the second embodiment and differs from the second embodiment in that a plurality of cover layers are provided.

As illustrated in FIG. 12, a golf ball 2 includes a spherical body 20, and the spherical body 20 is formed by a spherical, solid core layer 30 and first and second cover layers 32A and 32B covering the core layer 30.

The plurality of first regions 22 and the second regions 24 are formed on an outer surface of the second cover layer 32B. In other words, in the third embodiment, the spherical surface having a center of the spherical body 20 as a center is the outer surface of the second cover layer 32B.

With the third embodiment described above, the same effects as provided by the first embodiment are provided.

Fourth Embodiment

Next, a fourth embodiment with be described.

Figure 13:
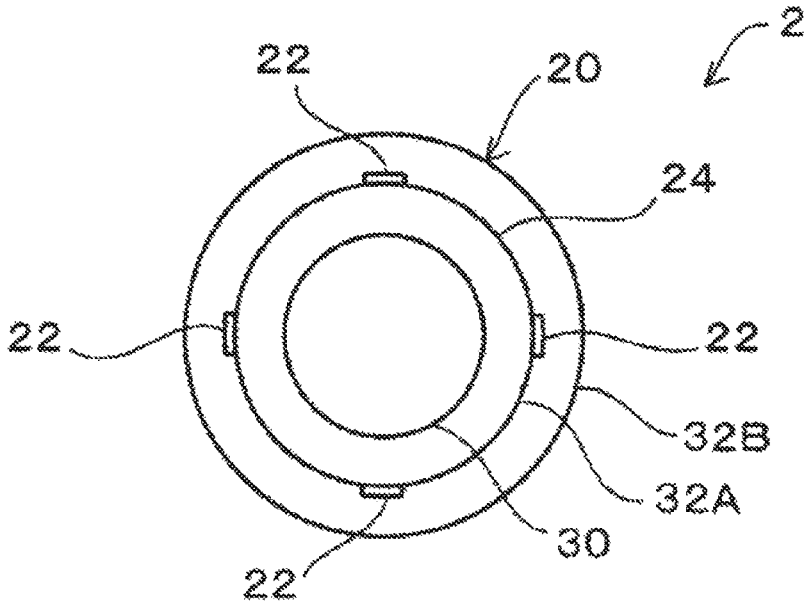
FIG. 13 is a cross-sectional view of a golf ball 2 according to a fourth embodiment.

FIG. 13 is a cross-sectional view of a golf ball 2 according to a fourth embodiment.

The fourth embodiment differs from the third embodiment in that positions where the first and second regions 22 and 24 are provided are different.

As illustrated in FIG. 13, the plurality of first regions 22 and the second regions 24 are formed on an outer surface of the first cover layer 32A or, in other words, are formed on an inner surface of the second cover layer 32B. In other words, in the fourth embodiment, the spherical surface having a center of the spherical body 20 as a center is the outer surface of the first cover layer 32A, or the inner surface of the second cover layer 32B.

In this case, the second cover layer 32B is non-electrically conductive and, thus, is formed from a material that allows the passage of radio waves.

It goes without saying that the same effects are provided by the fourth embodiment that are provided by the first embodiment. The first regions 22 are protected by the second cover layer 32B, and this is advantageous from the perspectives of suppressing peeling of the first regions 22 when the golf ball 2 is hit by a golf club head and enhancing durability.

Fifth Embodiment

Next, a fifth embodiment with be described.

Figure 14:
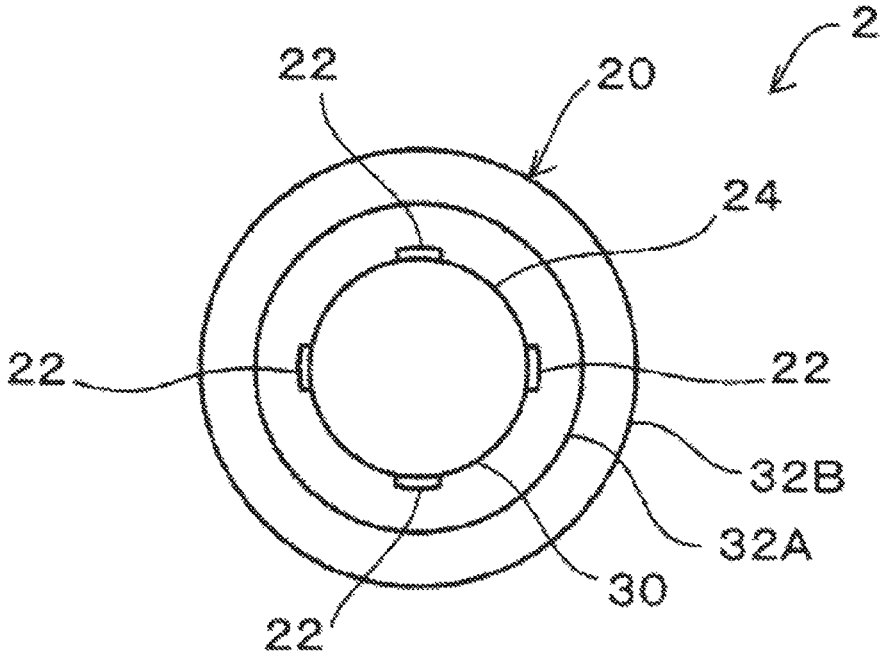
FIG. 14 is a cross-sectional view of a golf ball 2 according to a fifth embodiment.

FIG. 14 is a cross-sectional view of a golf ball 2 according to a fifth embodiment.

The fifth embodiment differs from the third and fourth embodiments in that the positions where the first and second regions 22 and 24 are provided are different.

As illustrated in FIG. 14, a plurality of first regions 22 and second regions 24 are formed on a surface of a core layer 30. In other words, in the fifth embodiment, the spherical surface having a center of the spherical body 20 as a center is the surface of the core layer 30.

In this case, the first and second cover layers 32A and 32B are non-electrically conductive and, thus, are formed from a material that allows the passage of radio waves.

It goes without saying that the same effects are provided by the fifth embodiment that are provided by the first embodiment. The first regions 22 are protected by the first and second cover layers 32A and 32B, and this is advantageous from the perspectives of suppressing peeling of the first regions 22 when the golf ball 2 is hit by a golf club head and enhancing durability.

Sixth Embodiment

Next, a sixth embodiment with be described.

Figure 15:
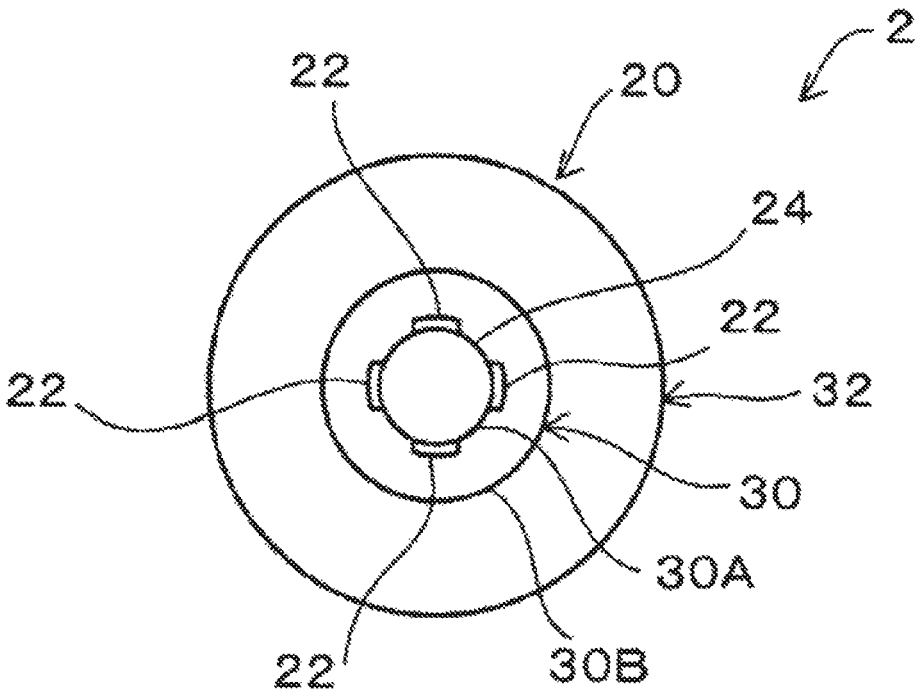
FIG. 15 is a cross-sectional view of a golf ball 2 according to a sixth embodiment.

FIG. 15 is a cross-sectional view of a golf ball 2 according to a sixth embodiment.

In the sixth embodiment, the core layer is provided with a two-layer construction.

As illustrated in FIG. 15, a spherical body 20 is formed by a spherical, solid core layer 30 and a cover layer 32 covering the core layer 30.

The core layer 30 is constituted by a spherical and solid inside core layer 30A and an outside core layer 30B that covers the inside core layer 30A.

A plurality of first regions 22 and second regions 24 are formed on a surface of the inside core layer 30A. In other words, in the sixth embodiment, the spherical surface having a center of the spherical body 20 as a center is an outer surface of the inside core layer 30A.

In this case, the outside core layer 30B and the cover layer 32 are non-electrically conductive and, thus, are formed from a material that allows the passage of radio waves.

It goes without saying that the same effects are provided by the sixth embodiment that are provided by the first embodiment. The first regions 22 are protected by the outside core layer 30B, and this is advantageous from the perspectives of suppressing peeling of the first regions 22 when the golf ball 2 is hit by a golf club head and enhancing durability.

Additionally, the plurality of first regions 22 and second regions 24 may be formed on an outer surface or an inner surface of the outside core layer 30B. In other words, in the sixth embodiment, the spherical surface having a center of the spherical body 20 as a center may be the outer surface or the inner surface of the outside core layer 30B, and in this case as well, the same effects are provided that are provided by the first embodiment.

Seventh Embodiment

Next, a seventh embodiment with be described.

Note that in embodiments 7 to 11, a case in which the present technology is applied to a hollow ball for a ball game such as, for example, a soft baseball, a hard baseball, a soft tennis ball, a volleyball, a soccer ball, a table tennis ball, or the like is described.

Figure 16:
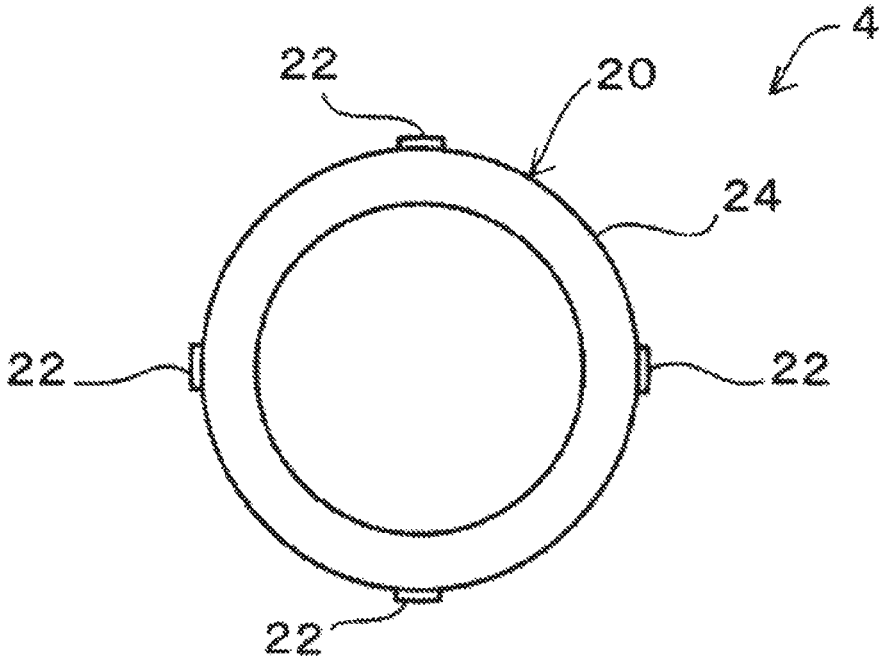
FIG. 16 is a cross-sectional view of a golf ball 2 according to a seventh embodiment.

FIG. 16 is a cross-sectional view illustrating a configuration of a ball for a ball game 4 according to a seventh embodiment.

As illustrated in FIG. 16, the ball for a ball game 4 includes a spherical body 20, first regions 22, and second regions 24.

The spherical body 20 is formed from a spherical, hollow core layer 40.

A plurality of first regions 22 and second regions 24 are formed on a surface of the core layer 40. In other words, in the seventh embodiment, the spherical surface having a center of the spherical body 20 as a center is an outer surface of the core layer 40.

With the seventh embodiment described above, the same effects as provided by the first embodiment are provided.

Eighth Embodiment

Next, an eighth embodiment with be described.

Figure 17:
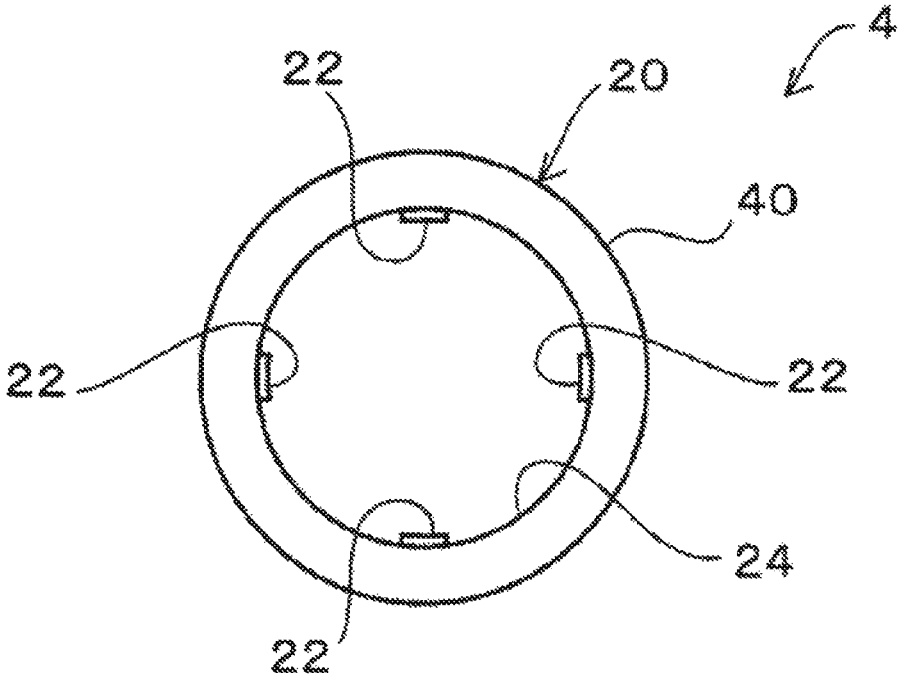
FIG. 17 is a cross-sectional view of a golf ball 2 according to an eighth embodiment.

FIG. 17 is a cross-sectional view illustrating a configuration of a ball for a ball game 4 according to an eighth embodiment.

The eighth embodiment differs from the seventh embodiment in that the positions where the first and second regions 22 and 24 are provided are different.

As illustrated in FIG. 17, a spherical body 20 is formed from a spherical, hollow core layer 40, the same as in the seventh embodiment.

A plurality of first regions 22 and second regions 24 are formed on an inner surface of the core layer 40. In other words, in the eighth embodiment, the spherical surface having a center of the spherical body 20 as a center is the inner surface of the core layer 40.

In this case, the core layer 40 is non-electrically conductive and, thus, is formed from a material that allows the passage of radio waves.

It goes without saying that the same effects are provided by the eighth embodiment that are provided by the first embodiment. The first regions 22 are protected by the core layer 40, and this is advantageous from the perspectives of suppressing peeling of the first regions 22 when the ball for a ball game 4 is hit by a bat, racket, or the like and enhancing durability.

Ninth Embodiment

Next, a ninth embodiment with be described.

Figure 18:
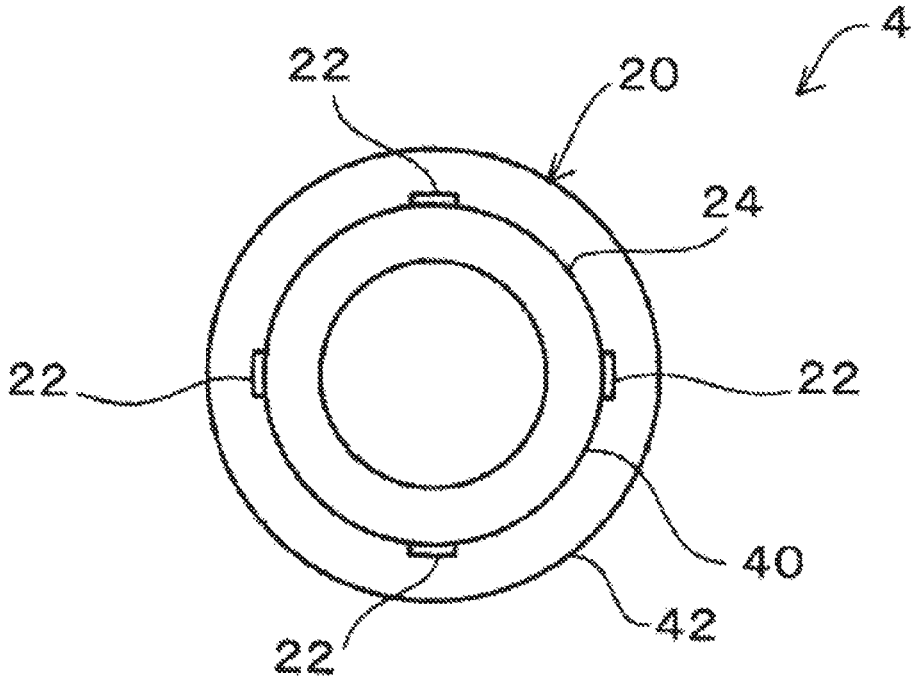
FIG. 18 is a cross-sectional view of a golf ball 2 according to a ninth embodiment.

FIG. 18 is a cross-sectional view illustrating a configuration of a ball for a ball game 4 according to a ninth embodiment.

As illustrated in FIG. 18, a spherical body 20 is formed by a spherical, hollow core layer 40 and a cover layer 42 covering the core layer 40.

A plurality of first regions 22 and second regions 24 are formed on an inner surface of the cover layer 42. In other words, in the ninth embodiment, the spherical surface having a center of the spherical body 20 as a center is the inner surface of the cover layer 42.

In this case, the core layer 40 is non-electrically conductive and, thus, is formed from a material that allows the passage of radio waves.

It goes without saying that the same effects are provided by the ninth embodiment that are provided by the first embodiment. The first regions 22 are protected by the cover layer 42, and this is advantageous from the perspectives of suppressing peeling of the first regions 22 when the ball for a ball game 4 is hit by a bat, racket, or the like and enhancing durability.

Tenth Embodiment

Next, a tenth embodiment with be described.

Figure 19:
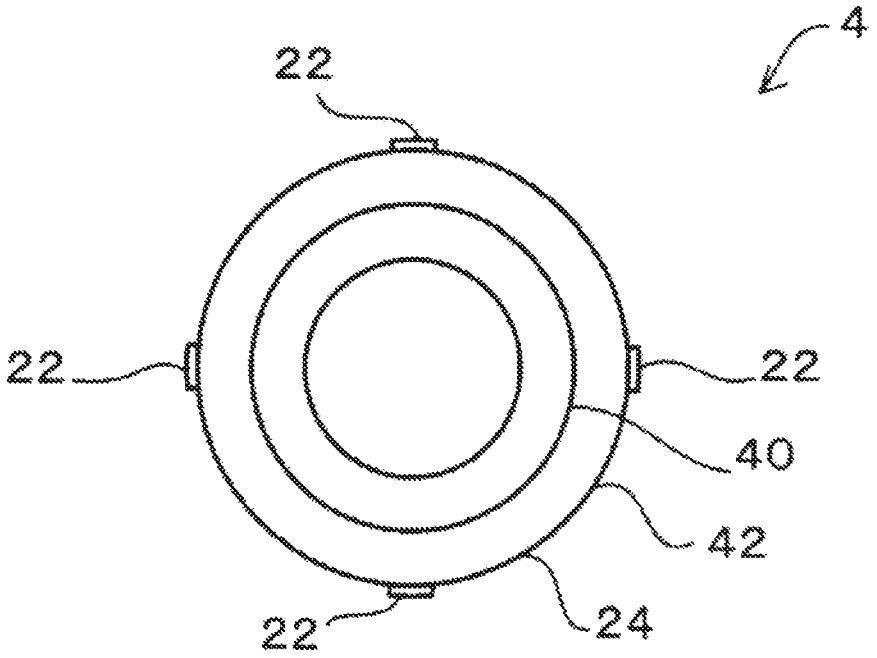
FIG. 19 is a cross-sectional view of a golf ball 2 according to a tenth embodiment.

FIG. 19 is a cross-sectional view illustrating a configuration of a ball for a ball game 4 according to a tenth embodiment.

The tenth embodiment differs from the ninth embodiment in that the positions where the first and second regions 22 and 24 are provided are different.

As illustrated in FIG. 19, a spherical body 20 is formed from a spherical, hollow core layer 40 and a cover layer 42 covering the core layer 40, the same as in the ninth embodiment.

A plurality of first regions 22 and second regions 24 are formed on an outer surface of the cover layer 42. In other words, in the tenth embodiment, the spherical surface having a center of the spherical body 20 as a center is the outer surface of the cover layer 42.

With the tenth embodiment described above, the same effects as provided by the first embodiment are provided.

Note that in the ninth and tenth embodiments, cases in which the cover layer 42 covering the core layer 40 is a single layer have been described, but two or more cover layers covering the core layer 40 may be used, and the plurality of first regions 22 and second regions 24 may be formed on an outer surface or an inner surface of any one of the cover layers.

In this case, the spherical surface having a center of the spherical body 20 as a center is the outer surface or the inner surface of the cover layer.

Eleventh Embodiment

Next, an eleventh embodiment with be described.

Figure 20:
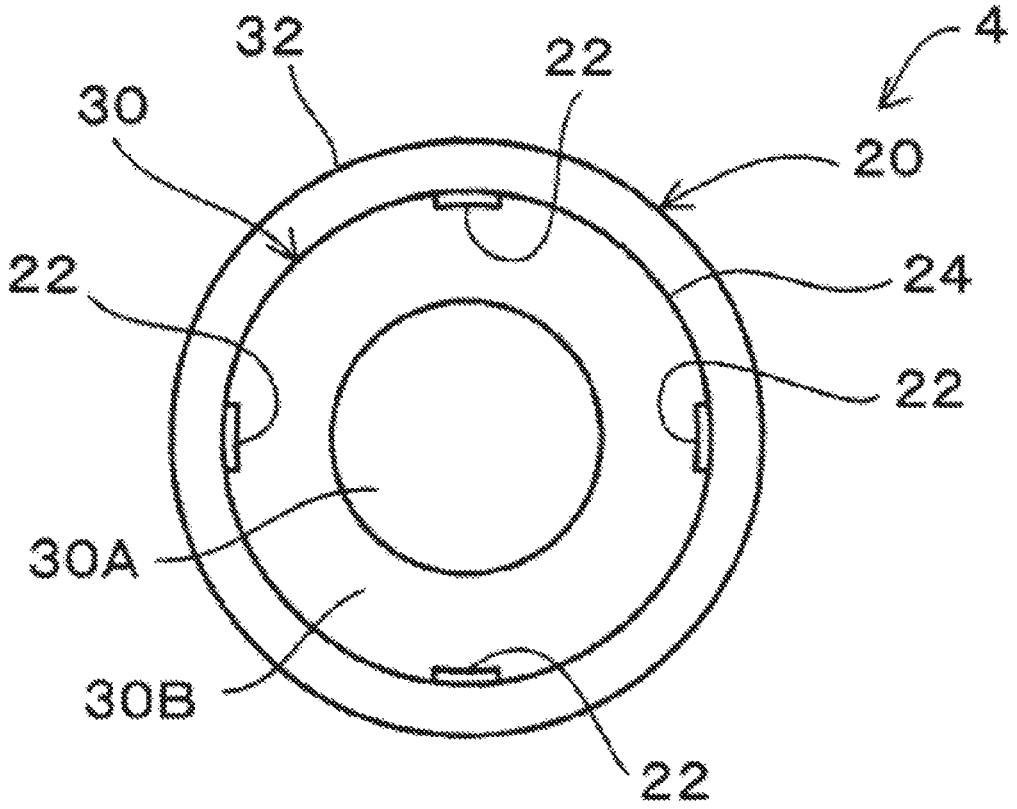
FIG. 20 is a cross-sectional view of a golf ball 2 according to an eleventh embodiment.

FIG. 20 is a cross-sectional view illustrating a configuration of a ball for a ball game 4 according to an eleventh embodiment.

In the eleventh embodiment, a case in which the ball for a ball game 4 is a hard baseball will be described.

A spherical body 20 is formed by a spherical, solid core layer 30 and a cover layer 32 covering the core layer 30.

The core layer 30 is constituted by a spherical and solid inside core layer 30A and an outside core layer 30B that covers the inside core layer 30A.

Examples of a material that can be used for the inside core layer 30A include various conventional materials such as rubber and the like.

Examples of a material that can be used for the outside core layer 30B include threads such as wool yarn, cotton yarn, and the like; or synthetic resin materials such as urethane foam and the like.

The outside core layer 30B is constituted by wool yarn or cotton yarn being wound so as to cover the inside core layer 30A or, alternatively, is constituted by a synthetic resin such as urethane foam being molded so as to cover the inside core layer 30A.

Examples of a material used as the cover layer 32 include cowhide, and the cover layer 32 is formed by stitching the cowhide using the thread so as to cover the outside core layer 30B.

Specifically, in this embodiment, the cover layer 32 is formed from a material that allows passage of radio waves such as, for example, a material that does not contain an electrically conductive substance so that radio waves will be reflected from the first regions 22.

The first regions 22 and the second regions 24 are formed on an inner surface of the cover layer 32 or, in other words, are formed on an outer surface of the outside core layer 30B.

Alternatively, the first regions 22 and the second regions 24 may by formed on the outer surface of the cover layer 32.

In other words, the spherical surface having a center of the spherical body 20 as a center is the outer surface of the outside core layer 30B or the inner surface or the outer surface of the cover layer 32.

With the eleventh embodiment described above, the same effects as provided by the first embodiment are provided.

First Experiment Example

Next, the results of an experiment of the golf ball 2 will be described. Note that the experiment described below was performed on the golf ball 2 of the first embodiment.

The results of a first experiment will be described. Experiment conditions are as follows:

In Comparative Example 1, the first regions 22 were not formed in the golf ball 2.

In Comparative Example 2, one of the first regions 22 was formed in the golf ball 2.

In Working Example 1, six of the first regions 22 were formed in the golf ball 2, having the configuration illustrated in FIG. 4.

Each of the golf balls 2 having the configuration described above was launched using a golf ball launcher and measured using the measuring apparatus 10. The Doppler signal Sd was then subjected to wavelet analyzing. The amount of spin imparted to the golf ball 2 by the golf ball launcher was 1,000 rpm or 3,000 rpm.

Ten of the golf balls 2 were measured for each of the Comparative Examples 1 and 2 and Working Example 1.

Figure 21:
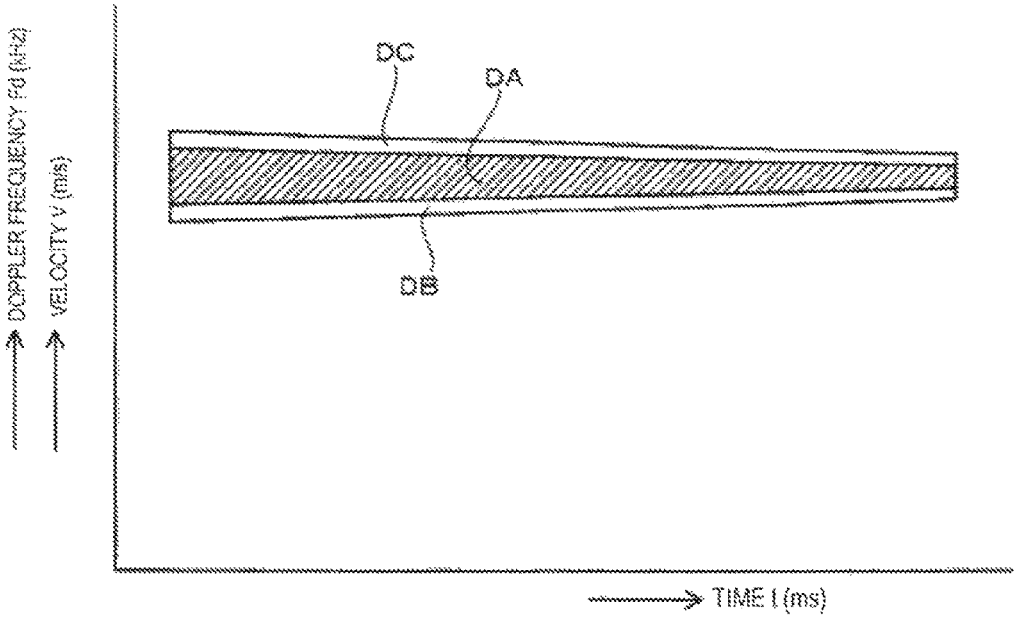
FIG. 21 is a chart showing the results of a wavelet analysis of a Doppler signal Sd for a case in which an amount of spin in Working Example 1 was 1,000 rpm.

FIG. 21 is a chart showing the results of a wavelet analysis of the Doppler signal Sd for a case in which an amount of spin in Working Example 1 was 1,000 rpm.

Figure 22:
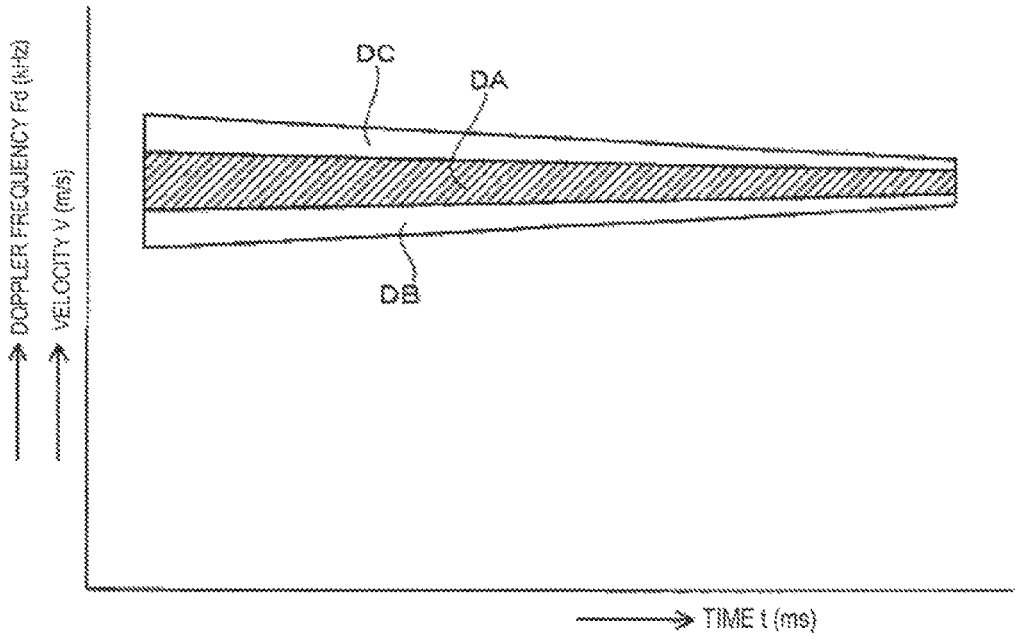
FIG. 22 is a chart showing the results of a wavelet analysis of a Doppler signal Sd for a case in which the amount of spin in Working Example 1 was 3,000 rpm.

FIG. 22 is a chart showing the results of a wavelet analysis of the Doppler signal Sd for a case in which an amount of spin in Working Example 1 was 3,000 rpm.

Figure 23:
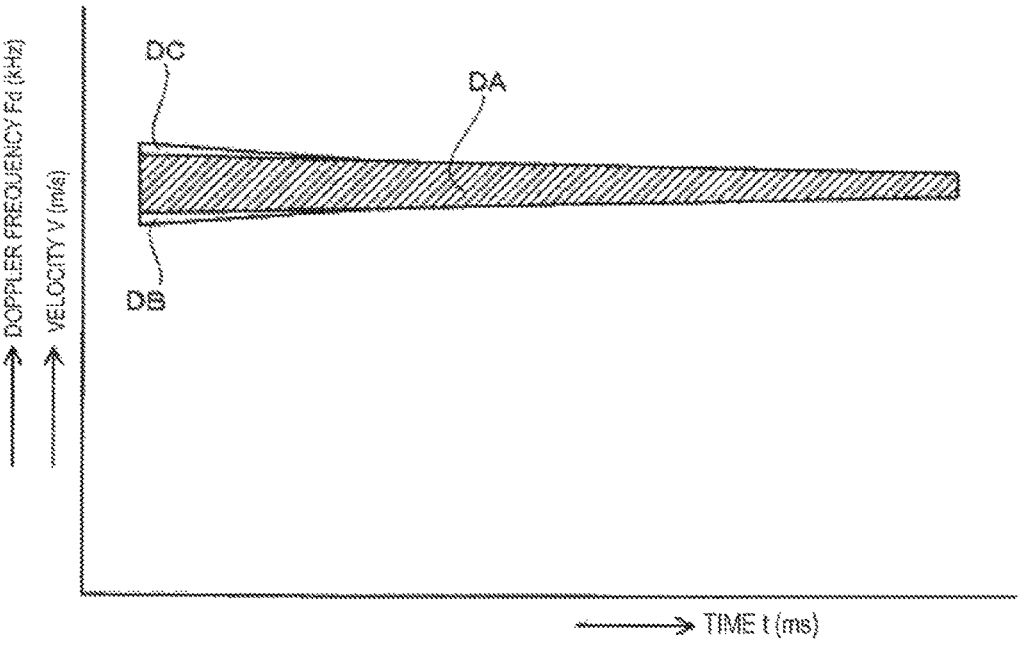
FIG. 23 is a chart showing the results of a wavelet analysis of a Doppler signal Sd for a case in which an amount of spin in Comparative Example 1 was 1,000 rpm.

FIG. 23 is a chart showing the results of a wavelet analysis of the Doppler signal Sd for a case in which an amount of spin in Comparative Example 1 was 1,000 rpm.

Figure 24:
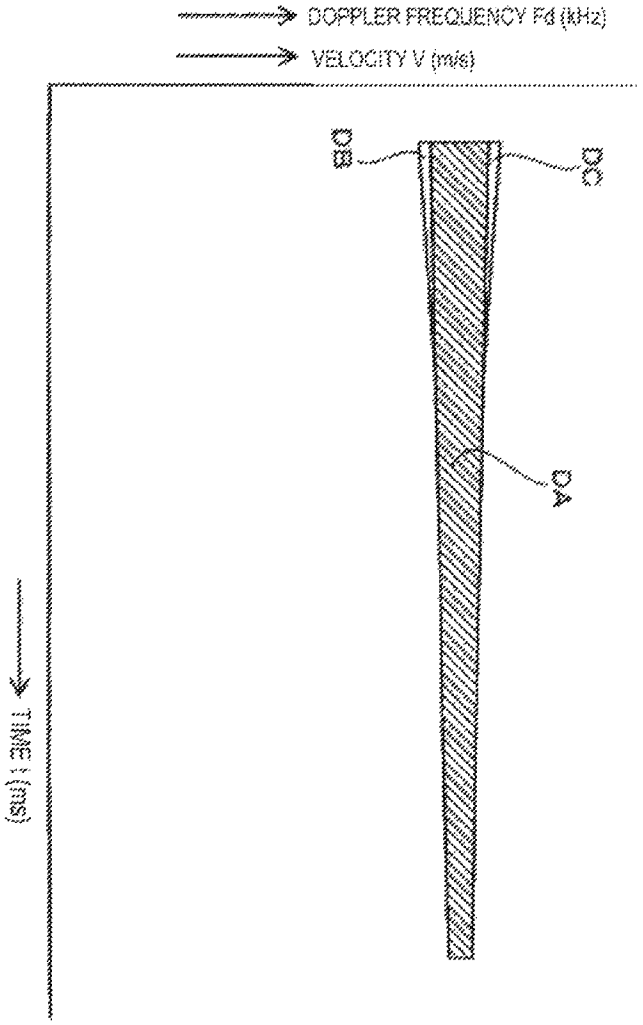
FIG. 24 is a chart showing an amount of spin in Comparative Example 2.

FIG. 24 is a chart showing the results of a wavelet analysis of the Doppler signal Sd for a case in which an amount of spin in Comparative Example 2 was 1,000 rpm. Time t (ms) is shown on the horizontal axis and the Doppler frequency Fd (kHz) and the velocity V (m/s) of the golf ball 2 are shown on the vertical axis.

Figures 25, 26:
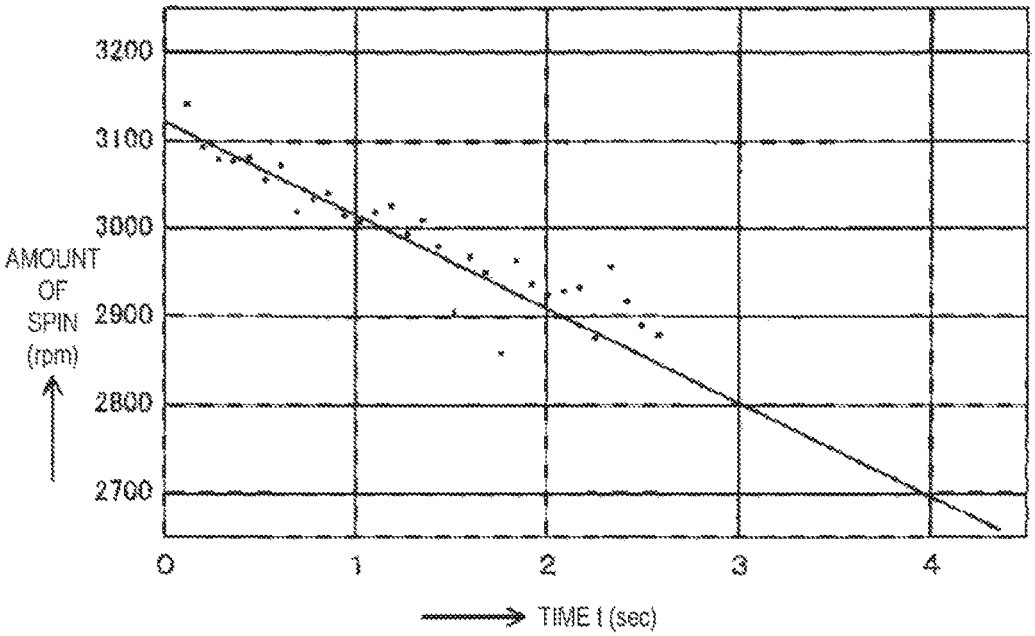
FIG. 25 is a table showing the results of measuring the amount of spin in Comparative Examples 1 and 2 and Working Example 1.
FIG. 26 is a chart showing the results of measuring an amount of spin in Working Example 2.

FIG. 25 is a table showing the results of measuring the amount of spin in Comparative Examples 1 and 2 and Working Example 1. When measurement of ten of the golf balls 2 was performed, a proportion (percentage) of the number of the golf balls 2 for which the amount of spin was able to be measured is shown.

As shown in FIGS. 21 and 22, in Working Example 1, while declining with the passage of time, a signal intensity of the second and third frequency distributions DB and DC sufficient for measuring the amount of spin is obtained.

Specifically, as shown in FIG. 25, regardless of whether the amount of spin imparted to the golf ball 2 when launched is 1,000 rpm or 3,000 rpm, it is 100% possible to measure the amount of spin.

In other words, a greater amount of spin leads to a decline of the second velocity VB and an increase in the third velocity VC described in FIG. 2. Therefore, widths of the second and third frequency distributions DB and DC will increase, which is advantageous from the perspective of ensuring the signal intensity of the second and third frequency distributions DB and DC.

Note that even if the amount of spin is the same, a greater number of the first regions 22 will lead to a stronger signal intensity of the reflection wave W2 reflected per unit time, which is advantageous from the perspective of ensuring the signal intensity of the second and third frequency distributions DB and DC.

As shown in FIGS. 23 and 24, in Comparative Examples 1 and 2, the width of the frequency distribution of the Doppler signal Sd is smaller than that in FIGS. 21 and 22. The signal intensities of the second and third frequency distributions DB and DC are weak and, with the passage of time, the second and third frequency distributions DB and DC decline and eventually disappear.

Specifically, as shown in FIG. 25, when the amount of spin imparted to the golf ball 2 when launched is low at 1,000 rpm, the amount of spin is not measurable in Comparative Example 1, and only 30% of the amount of spin is measurable in Comparative Example 2.

Additionally, when the amount of spin is set high at 3,000 rpm, it is 100% possible to measure the amount of spin in Comparative Examples 1 and 2.

This is because the width of the second and third frequency distributions (the width of the frequency distribution of the Doppler signal Sd) is large due to a greater amount of spin leading to a decline of the second velocity VB and an increase in the third velocity VC.

From the results of the experiment described above, it is clear that using the golf ball 2 of this embodiment is advantageous from the perspective of stably and reliably measuring the amount of spin regardless of a value of the amount of spin.

Second Experiment Example

Next, a second experiment example with be described.

Experiment conditions are as follows:

In Comparative Example 3, the first regions 22 were not formed in the golf ball 2.

In Comparative Example 4, one of the first regions 22 was formed in the golf ball 2.

In Working Example 2, six of the first regions 22 were formed in the golf ball 2, having the configuration illustrated in FIG. 4.

The amount of spin of the golf balls 2 with the passage of time was obtained by launching each of the golf balls 2 having the configuration described above using a golf ball launcher and measuring using the measuring apparatus 10.

The initial velocity imparted to the golf ball 2 by the golf ball launcher was set to be 60 m/s and the amount of spin imparted to the golf ball 2 to be 3,000 rpm. Ten of the golf balls 2 were measured for each of the Comparative Examples 3 and 4 and Working Example 2.

Figure 27:
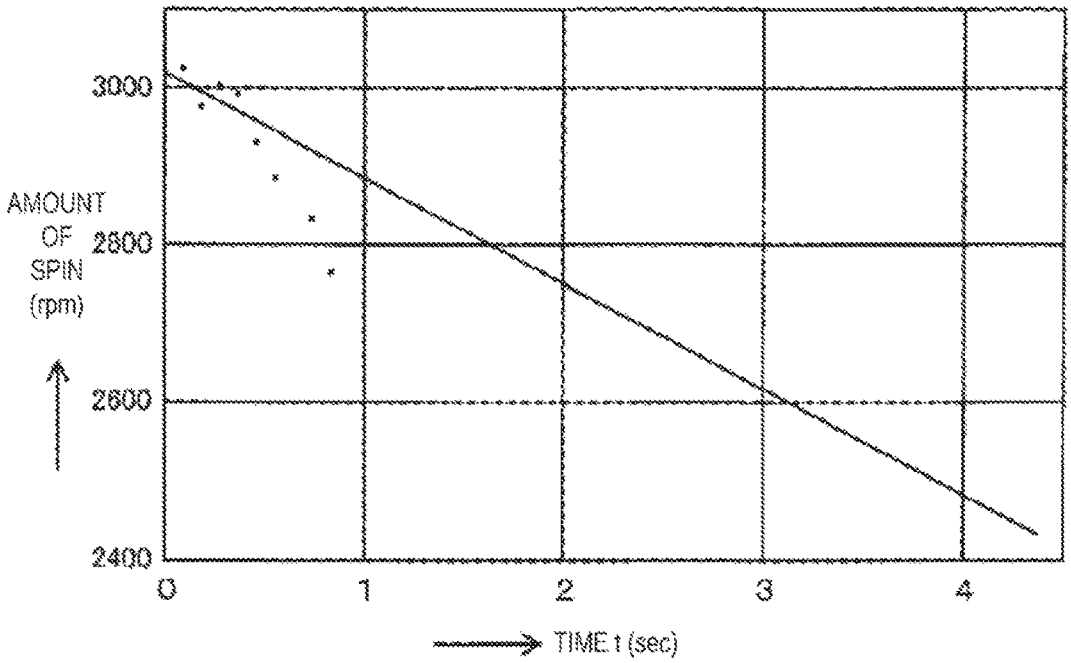
FIG. 27 is a chart showing the results of measuring an amount of spin in Comparative Example 3.
Figure 28:
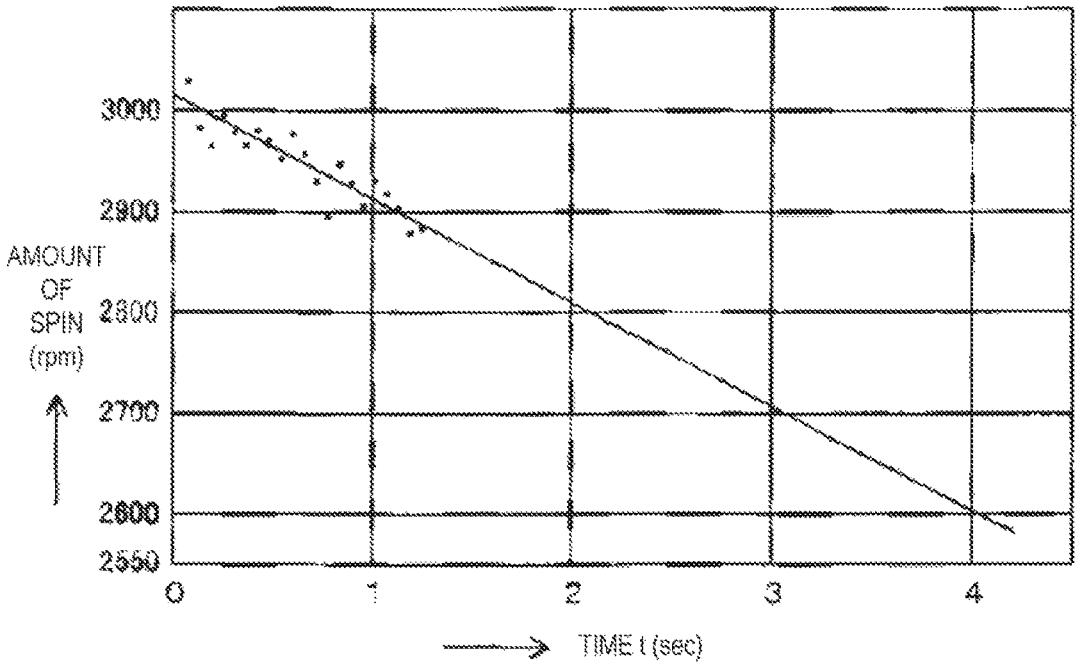
FIG. 28 is a chart showing the results of measuring an amount of spin in Comparative Example 4.

FIG. 26 is a chart showing the results of measuring an amount of spin in Working Example 2. FIG. 27 is a chart showing the results of measuring an amount of spin in Comparative Example 3. FIG. 28 is a chart showing the results of measuring an amount of spin in Comparative Example 4.

Note that the solid lines shown in FIGS. 26, 27, and 28 are straight lines showing changes in the passage of time and the amount of spin, calculated based on each measured value of the amount of spin.

FIG. 29 is a table showing a measuring time and a following distance of the amount of spin in Comparative Examples 3 and 4 and Working Example 2. Average values of measurements for ten of the golf balls 2 are shown.

As shown in FIG. 26, when there were zero of the first regions 22, the measuring time was 1.1 seconds and the following distance was 66 m. However, there was a great amount of variation in the measurement data of the amount of spin from 0.5 seconds and the values usable as measurement data of the amount of spin were 0.5 seconds for the measuring time and 30 m for the following distance.

As shown in FIG. 27, when there was one of the first regions 22, the measuring time was 1.25 seconds and the following distance was 75 m.

As shown in FIG. 28, when there were six of the first regions 22, the measuring time was 2.6 seconds and the following distance was 156 m.

From the results described above, it is clear that when the number of the first regions 22 is zero, the measuring time is limited to 0.5 seconds and the following distance is limited to 30 m.

Additionally, it is clear that compared to when the number of the first regions 22 is one, when the number is six a greater measuring time and following distance can be ensured.

From the results of the experiment described above, it is clear that by using the golf ball 2 of this embodiment measuring time and following distance of the amount of spin can be ensured, which is advantageous from the perspective of stably and reliably measuring the amount of spin.

Twelfth Embodiment

Next, a twelfth embodiment with be described.

Figure 30:
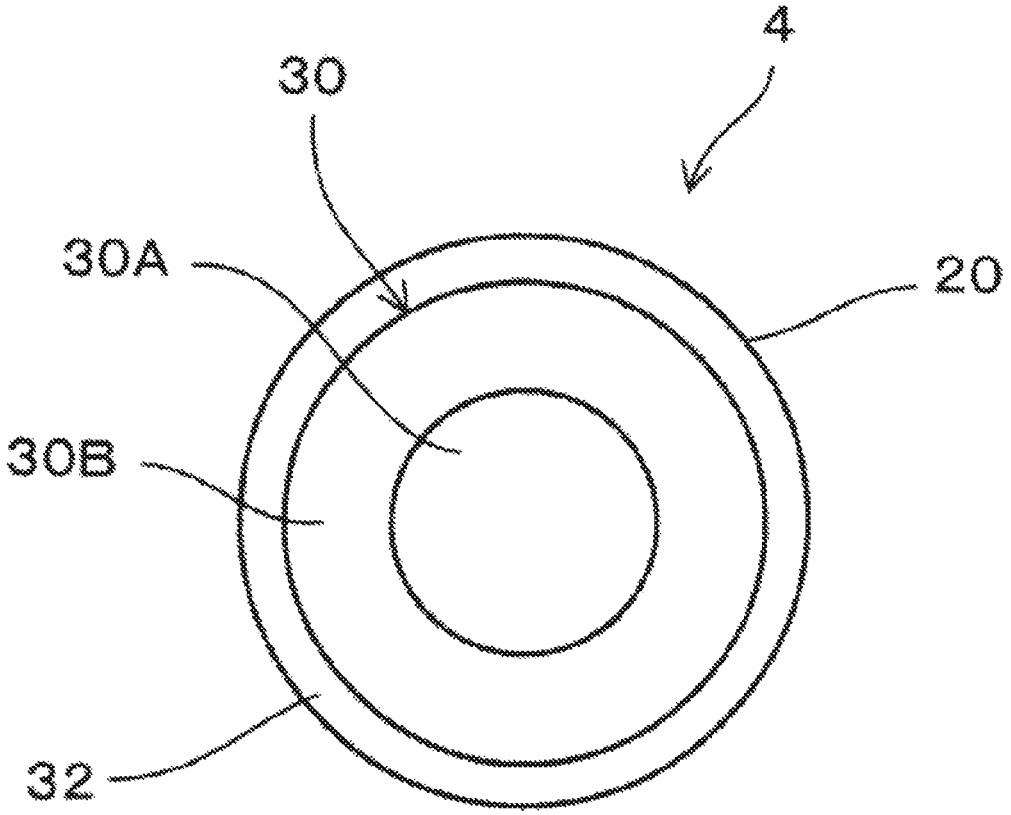
FIG. 30 is a cross-sectional view illustrating a configuration of a ball for a ball game 4 according to a twelfth embodiment.
Figure 31:
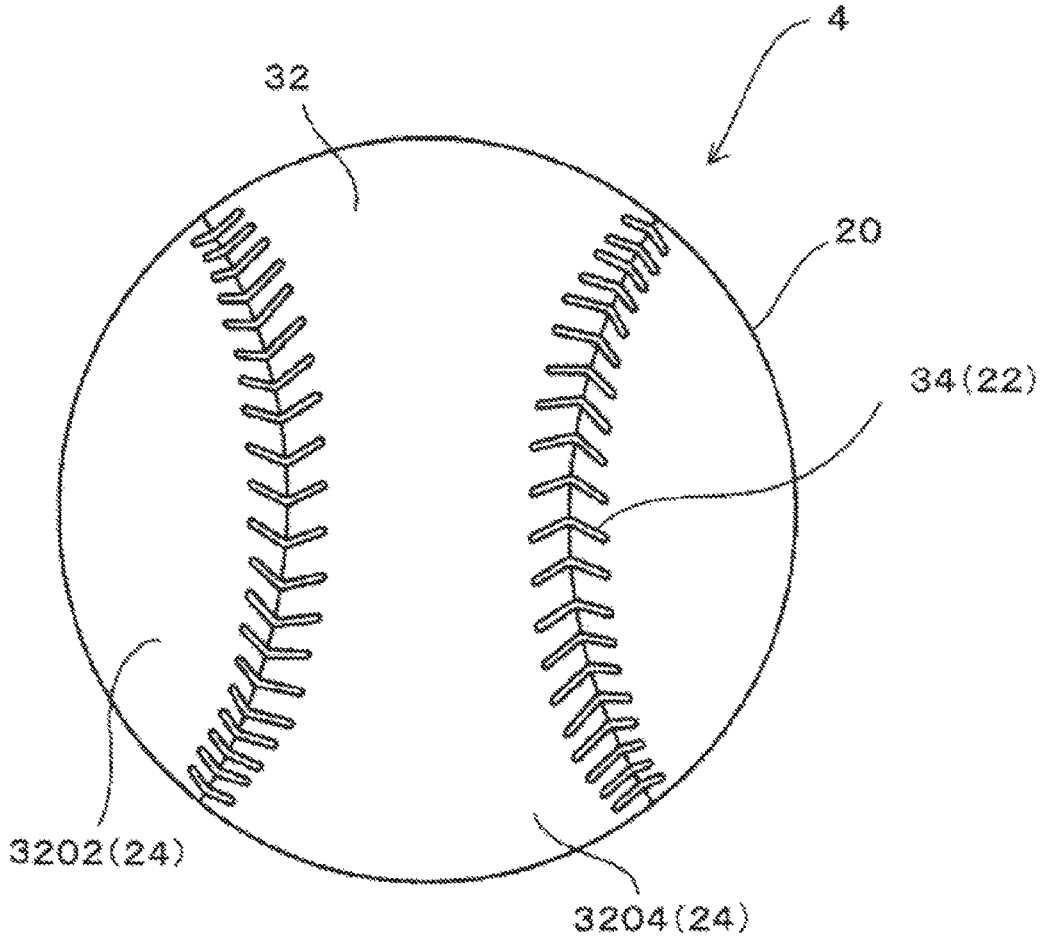
FIG. 31 is a front view illustrating the configuration of the ball for a ball game 4 according to the twelfth embodiment.

FIG. 30 is a cross-sectional view illustrating a configuration of a ball for a ball game 4 according to a twelfth embodiment. FIG. 30 is a front view illustrating the configuration of the ball for a ball game 4 according to the twelfth embodiment.

In the twelfth embodiment, a case in which the ball for a ball game 4 is a hard baseball, the same as in the eleventh embodiment, will be described.

The ball for a ball game 4 includes a spherical body 20, and the spherical body 20 is formed by a spherical, solid core layer 30 and a cover layer 32 covering the core layer 30. The core layer 30 is constituted by a spherical, solid inside core layer 30A and an outside core layer 30B covering the inside core layer 30A.

The cover layer 32 is formed by a plurality of outer coverings 3202 and 3204 being sewn together using stitching 34.

In this case, the spherical surface having a center of the spherical body 20 as a center is an outer surface of the cover layer 32.

The stitching 34 has radio wave reflectability.

The stitching 34 has high radio wave reflectability, the same as the first regions 22 of the eleventh embodiment, and efficiently reflects radio waves (microwaves).

It is sufficient that the stitching 34 be able to ensure a sufficient intensity of the reflection wave W2 and, as in the first embodiment, a surface resistance thereof must be no more than 130 Ω/sq.

Examples of the stitching 34 that can be used include thread formed from an electrically conductive material or thread impregnated with an electrically conductive material.

Alternatively, the stitching 34 may be provided with radio wave reflectability by impregnating the stitching 34 with an electrically conductive material after sewing together the outer coverings 3202 and 3204 using the stitching 34.

The outer coverings 3202 and 3204 are formed from a material having a radio wave reflectance lower than the radio wave reflectance of the stitching 34.

Thus, in the twelfth embodiment, the first regions 22 are constituted by the stitching 34 and the second regions 24 are constituted by the outer coverings 3202 and 3204.

With the twelfth embodiment described above, the same effects as provided by the first embodiment are provided.

Thirteenth Embodiment

Next, a thirteenth embodiment with be described.

Figure 32:
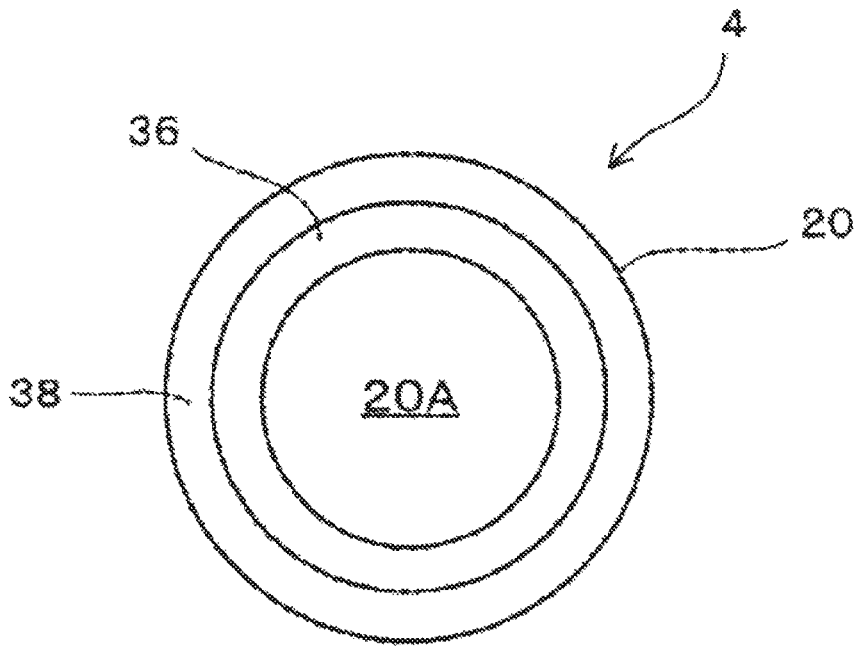
FIG. 32 is a cross-sectional view illustrating a configuration of a ball for a ball game 4 according to a thirteenth embodiment.
Figure 33:
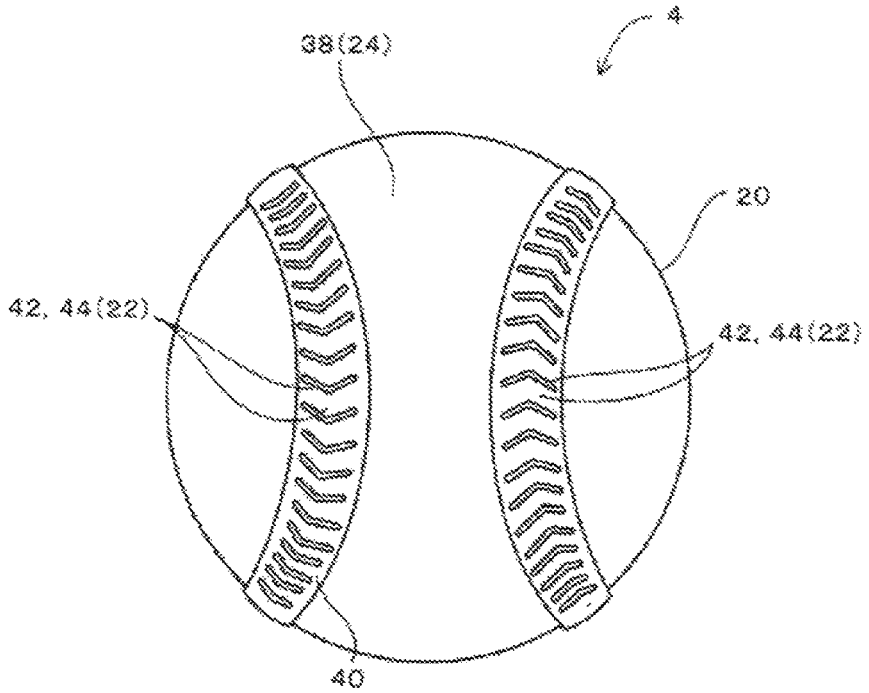
FIG. 33 is a front view illustrating a configuration of the ball for a ball game 4 according to the thirteenth embodiment.

FIG. 32 is a cross-sectional view illustrating a configuration of a ball for a ball game 4 according to a thirteenth embodiment. FIG. 33 is a front view illustrating the configuration of the ball for a ball game 4 according to the thirteenth embodiment.

In the thirteenth embodiment, the ball for a ball game 4 is a soft baseball formed so as to be hollow.

The ball for a ball game 4 of the thirteenth embodiment includes a spherical body 20, and the spherical body 20 is formed from a spherical, hollow core layer 36 and a cover layer 38 covering the core layer 36. In the drawing, the reference number 20A indicates a hollow portion.

In this case, the spherical surface having a center of the spherical body 20 as a center is an outer surface of the cover layer 38.

Examples of a material that can be used for the core layer 36 and the cover layer 38 include elastic materials such as rubber and the like.

The outer surface of the cover layer 38 is formed from a surface of the cover layer 38 that constitutes the spherical surface, a band region 40 formed extending band-like along the surface, and a plurality of recesses and protrusions 42 formed throughout an overall length of the band region 40.

A reflecting portion 44 having radio wave reflectability is formed in the recesses and/or the protrusions that constitute the plurality of recesses and protrusions 42, The reflecting portion 44 has high radio wave reflectability, the same as the first regions 22 of the first embodiment, and efficiently reflects radio waves (microwaves).

It is sufficient that the reflecting portion 44 be able to ensure a sufficient intensity of the reflection wave W2 and, as in the first embodiment, a surface resistance thereof must be no more than 130 Ω/sq.

An electrically conductive material can be used as a material constituting the reflecting portion 44, the same as for the first regions 22 of the first embodiment.

Examples of the electrically conductive material include coating materials containing a metal powder. The reflecting portion 44 is formed by applying (printing) such a coating material on the recesses and/or the protrusions that constitute the plurality of recesses and protrusions 42.

Additionally, the electrically conductive material may be a metal foil. The reflecting portion 44 can be formed by affixing such a metal foil using an adhesive to the recesses and/or the protrusions that constitute the plurality of recesses and protrusions 42.

Examples of such a metal foil that can be used include various conventional metal foils such as aluminum foil and the like.

Additionally, the reflecting portion 44 may be formed by depositing the electrically conductive material on the recesses and/or the protrusions that constitute the plurality of recesses and protrusions 42.

Additionally, the reflecting portion 44 may be constituted by a deposited film or a discontinuous deposited film formed by depositing the electrically conductive material on the recesses and/or the protrusions that constitute the plurality of recesses and protrusions 42.

Note that examples of the electrically conductive material that can be used include electrically conductive substances other than metals such as various conventional materials that contain carbon and the like.

Additionally, the reflecting portion 44 may be formed using a combination of an electrically conductive material and a non-conducting material.

Additionally, the reflecting portion 44 may be constituted by thread formed from an electrically conductive material that is embedded in the band region 40 along the band region 40, or by thread that is impregnated with the electrically conductive material.

Metal wire may be used as such a thread.

Thus, in the thirteenth embodiment, the first regions 22 are constituted by the reflecting portion 44, and the second regions 24 are constituted by portions of the outer surface of the cover layer 38 other than where the reflecting portion 44 is formed.

With the thirteenth embodiment described above, the same effects as provided by the first embodiment are provided.

Fourteenth Embodiment

Next, a fourteenth embodiment with be described.

The fourteenth embodiment relates to a method of manufacturing a ball for a ball game.

In the fourteenth embodiment, a case in which a ball for a ball game 2 is a golf ball will be described.

Figure 34:
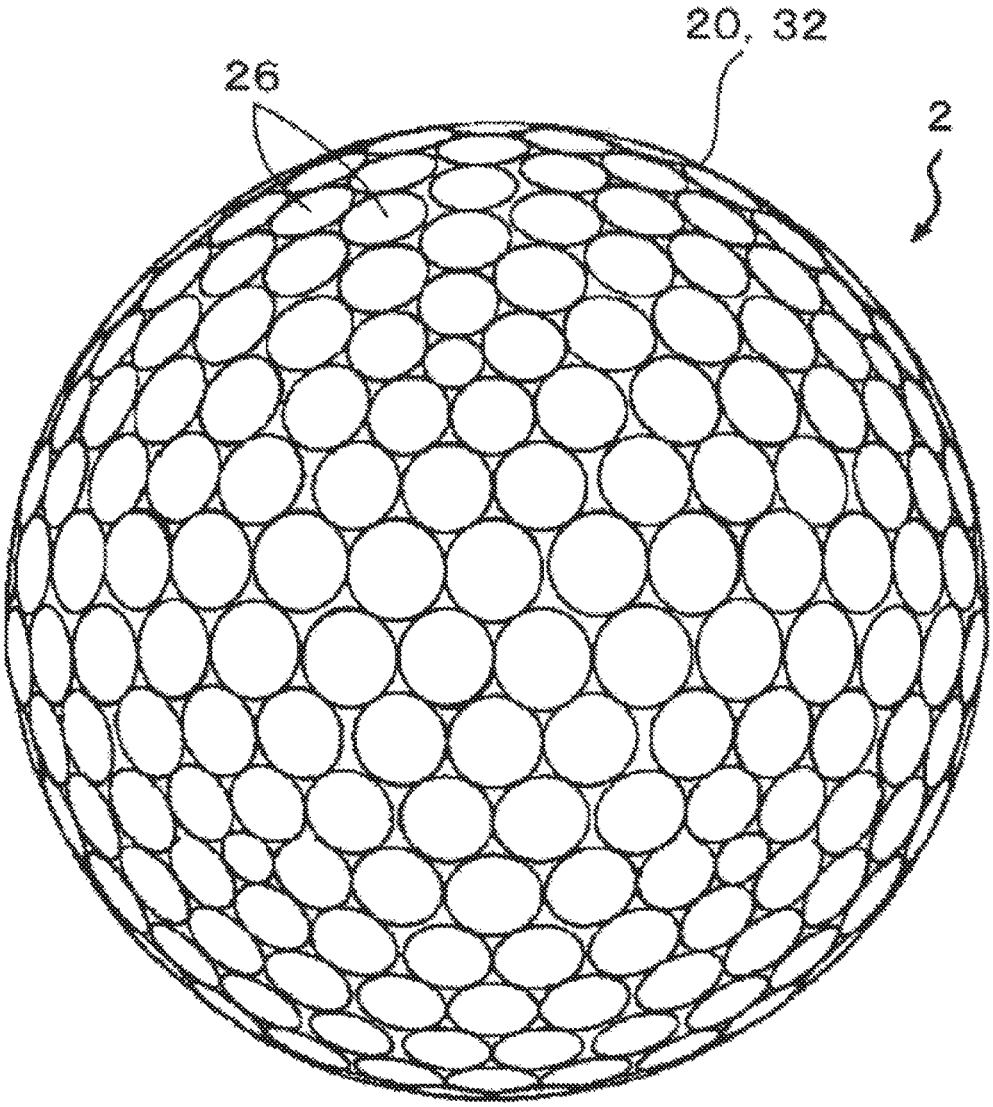
FIG. 34 is a cross-sectional view of a ball for a ball game 2 according to a fourteenth embodiment, prior to first regions 22 being formed.
Figure 35:
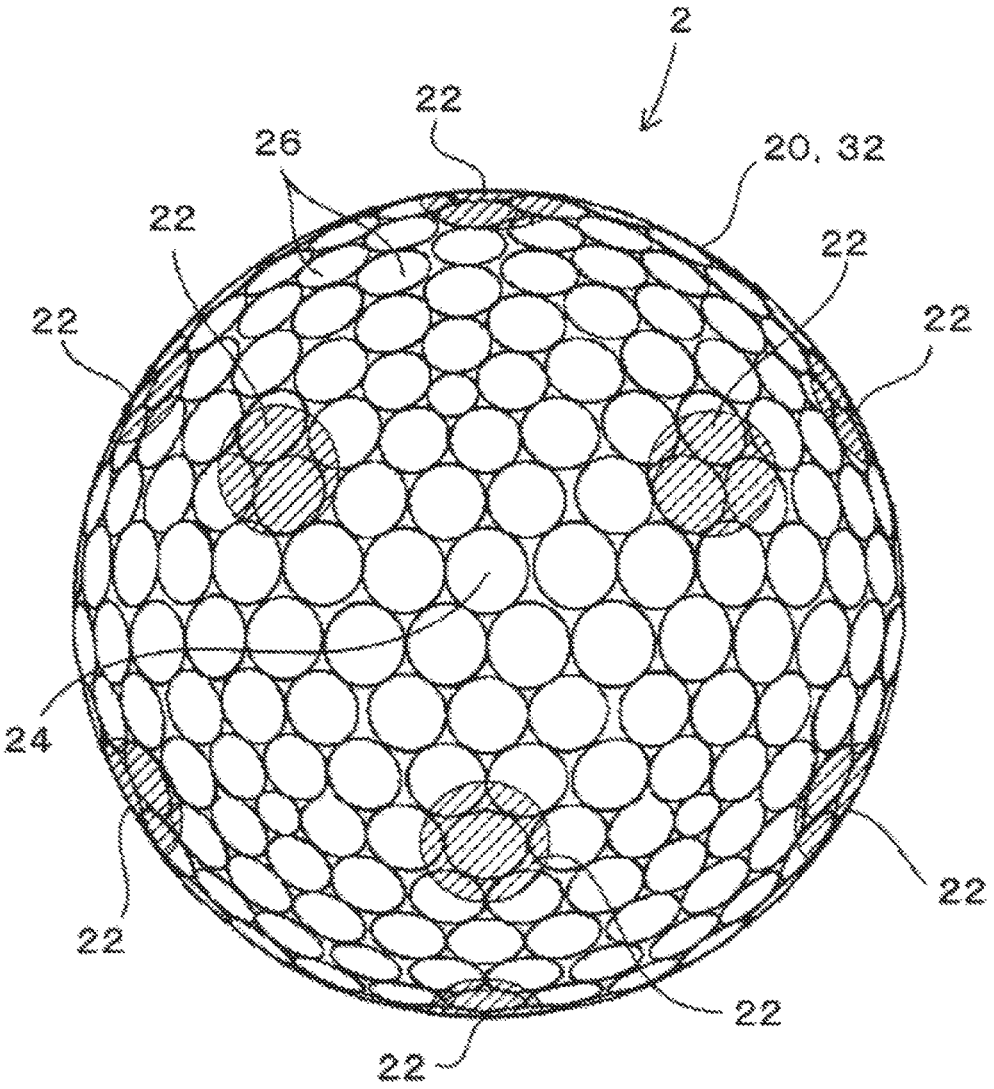
FIG. 35 is a plan view of the ball for a ball game 2 after the first regions 22 were formed.
Figure 36:
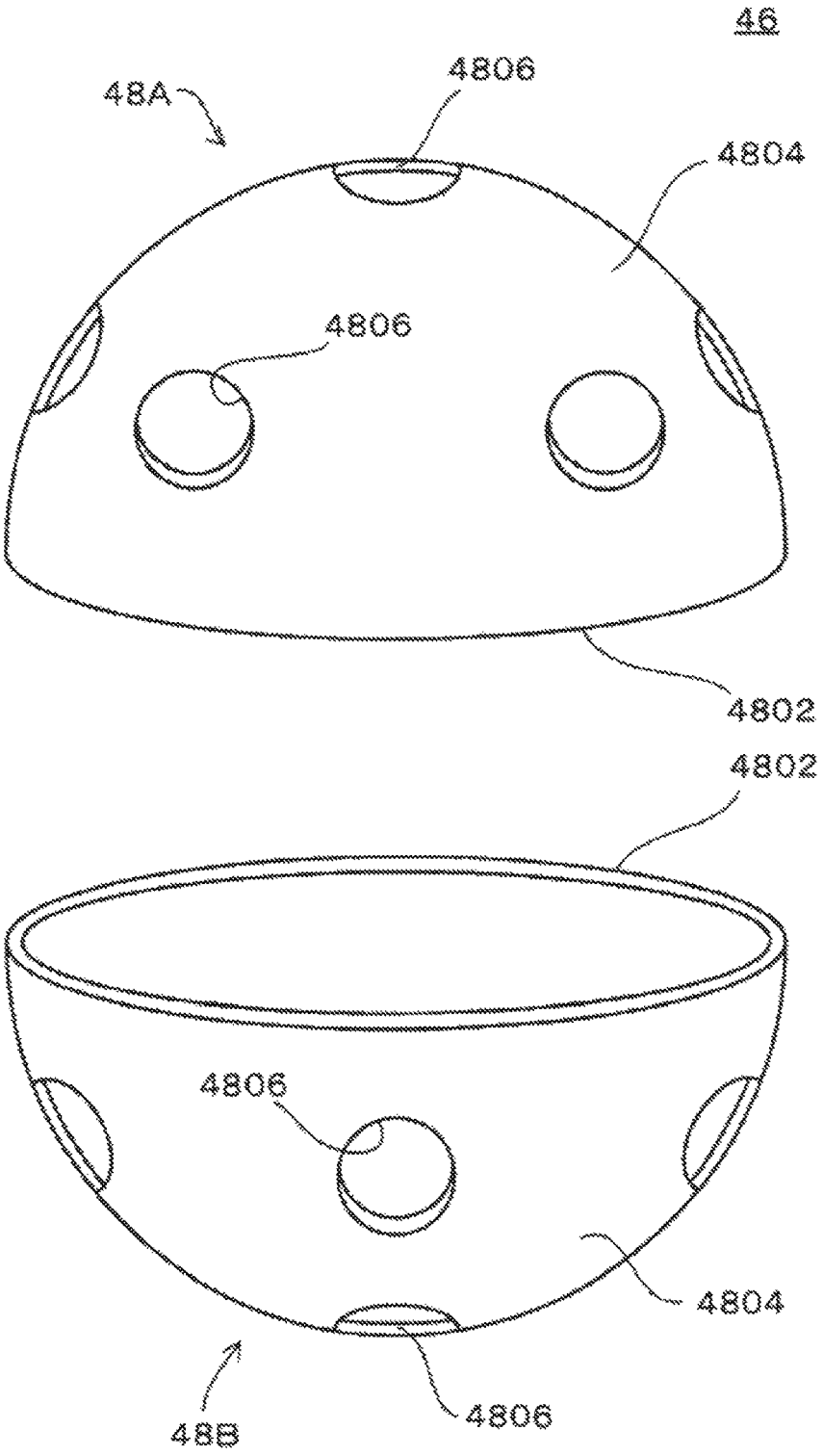
FIG. 36 is a perspective view illustrating a configuration of a mold 30.

FIG. 34 is a cross-sectional view of the golf ball 2 according to a fourteenth embodiment, prior to deposition regions 24 being formed. FIG. 35 is a plan view of the golf ball 2 after the deposition regions 24 were formed. FIG. 36 is a perspective view illustrating a configuration of a mold 30.

First the ball for a ball game 2 illustrated in FIG. 34 is prepared.

The ball for a ball game 2 includes a spherical body 20 formed from a first material.

Specifically, a spherical body 20 is formed from a solid, spherical core layer and a cover layer 32 made from a synthetic resin covering the core layer. A multiplicity of dimples 26 are formed in a surface of the cover layer 32.

The cover layer 32 extends on a spherical surface having a center of the spherical body 20 as a center and the cover layer 32 is formed from the first material.

The first material may be a material with absolutely no radio wave reflectance or a material with a radio wave reflectance lower than that of a second material described below. For example, a synthetic material or the like can be used.

Next, a mold 46 illustrated in FIG. 36 is prepared.

The mold 46 includes first and second portions 48A and 48B that are each hollow and hemispherical.

The first and second portions 48A and 48B are constituted so as to form a hollow, spherical body having an inner diameter that is approximately the same as an outer diameter of the spherical body 20 by aligning toric edges 4802 thereof.

The first and second portions 48A and 48B each include a main body portion 4804 extending on a spherical surface and a plurality of windows 4806 formed penetrating the main body portion 4804.

In other words, the mold 46 includes the main body portion 4804 that covers the second regions 24 described below and the windows 4806 formed in the main body portion 4804 that expose the deposition regions 24 described below.

In this embodiment, each of the windows 4806 has a circular shape with the same diameter.

Additionally, each of the windows 4806 is positioned at vertices of an imaginary regular polyhedron or a semiregular polyhedron such that the vertices are positioned on a surface of the hollow spherical body (spherical surface having a center of the hollow spherical body as a center).

The first and second portions 48A and 48B are fitted over the spherical body 20, and the edges 4802 of the first and second portions 48A and 48B are secured in an aligned state, thereby enclosing the spherical body 20 in the mold 46.

Thus, a state in which the surface of the spherical body 20 or, in other words, the spherical surface having a center of the spherical body 20 as a center is exposed via each of the windows 4806 is obtained.

Next, the second material having a radio wave reflectance greater than that of the first material is prepared.

Examples of the second material that can be used include various conventional metals such as silver, copper, gold, nickel, aluminum, iron, titanium, tungsten, and the like; or electrically conductive substances other than metals such as various conventional materials containing carbon and the like.

Next, the golf ball 2 enclosed in the mold 46 is placed in a deposition device and the second material is deposited.

Specifically, by heating, vaporizing, or sublimating the second material in a vacuum sealed container, the second material is deposited on the spherical surface of the spherical body 20 exposed from the windows 4806, that is enclosed in the mold 46.

Thus, as illustrated in FIG. 35, the first regions 22 (deposition regions) are formed by the second material being deposited on the portions of the spherical surface of the spherical body 20 that are exposed via the windows 4806, thereby forming a thin film. Additionally, the second regions 24 are formed by the second material not being deposited on the portions of the spherical surface of the spherical body 20 that are covered by the main body portion 4804.

In other words, the first regions 22 are formed by depositing the second material on the first material via vacuum deposition, and the second regions 24 that are formed from the first material are formed by not depositing the second material in areas (non-deposition regions) other than the where the first regions 22 are formed.

Note that examples of the deposition device that can be used include various conventional deposition devices.

Additionally, in this embodiment, the shape of each of the first regions 22 corresponds to the windows 4806 of the mold 46 and is circular with the same diameter, but the shape of each of the first regions 22 may be triangular, rectangular, regular polygonal, or the like. Additionally, the number and disposal position of each of the first regions 22 may be set as desired. In summary, it is sufficient that the first regions 22 be able to reflect the transmission wave W1.

Note that the first regions 22 may be formed from either a deposited film or a discontinuous deposited film.

The deposited film is electrically conductive.

Additionally, a discontinuous deposited film is a deposited film in a state where atoms vaporized from a target are deposited on the surface of the spherical body 20 (non-deposition body) and the deposition is stopped at a stage during the process of growth of a plurality of growth sites when each of the growth sites is not in contact with each other or, in other words, when each of the growth sites is not continuous so that the growth sites are in a state of electrical non-conductivity.

Thus, in the discontinuous deposited film, electrical conductivity does not exist between the growth sites and a non-conducting body is formed.

Additionally, the first regions 22 may be formed from either a deposited film or a discontinuous deposited film and, to summarize, it is sufficient that the first regions 22 have a higher radio wave reflectance than the first material.

In other words, it is sufficient that the first regions 22 be able to ensure a sufficient intensity of the reflection wave W2, and a necessary range of the surface resistance of the first regions 22 is the same as that in the first embodiment.

As illustrated in FIG. 35, a ball for a ball game 2 having the first regions 22 and the second regions 24 formed on the spherical surface of the spherical body 20 is manufactured as described above.

Note that a film made of synthetic resin may be formed on all regions of the first regions 22 and the second regions 24.

As a result of such a configuration, the first regions 22 are protected by the film made of synthetic resin. This is advantageous from the perspectives of suppressing peeling of the first regions 22 when the ball for a ball game 2 is hit by a golf club head and enhancing durability.

The synthetic resin may be transparent or opaque.

If the synthetic resin is transparent, the first regions 22 will be visible, which leads to a benefit of ease of recognition that the ball for a ball game 2 is suited for measurement by a Doppler radar.

Additionally, if the synthetic resin is opaque, the first regions 22 will be hidden by the film made of synthetic resin, which is advantageous from the perspectives of enhancing the appearance of the ball for a ball game 2 and achieving a degree of freedom of design therefor.

With the ball for a ball game 2 manufactured as described above, the same effects as provided by the first embodiment are provided.

Moreover, with the manufacturing method of this embodiment, the ball for a ball game 2 having the effects described above was manufactured by means of deposition.

The metal foil is affixed or, alternatively, the coating material is applied or printed, which is advantageous from the perspectives of manufacturing a large amount of the balls for a ball game 2 in a short period of time and reducing production costs compared to cases in which regions having a high radio wave reflectance are formed on the spherical surface of the spherical body 20.

Additionally, the first regions 22 can be formed having an extremely thin film thickness and the film thickness can be managed with a high degree of precision, which is advantageous from the perspective of obtaining a measurable ball for a ball game 2 of high quality.

Moreover, when regions having a high radio wave reflectance are formed on the spherical surface of the spherical body 20 by applying or printing the coating material, the film thickness will be uneven, but for the first regions 22, the film thickness can be managed with a high degree of precision, which is advantageous from the perspectives of being able to suppress the unevenness of the radio wave reflectance Γ and perform measurements using a Doppler radar with a high degree of precision.

Fifteenth Embodiment

Next, a fifteenth embodiment will be described while referencing FIGS. 37 and 38.

In the fifteenth embodiment, a case in which a ball for a ball game 2 is a golf ball will be described.

The fifteenth embodiment differs from the fourteenth embodiment in that the method for forming the first and second regions 22 and 24 is different.

Figure 37:
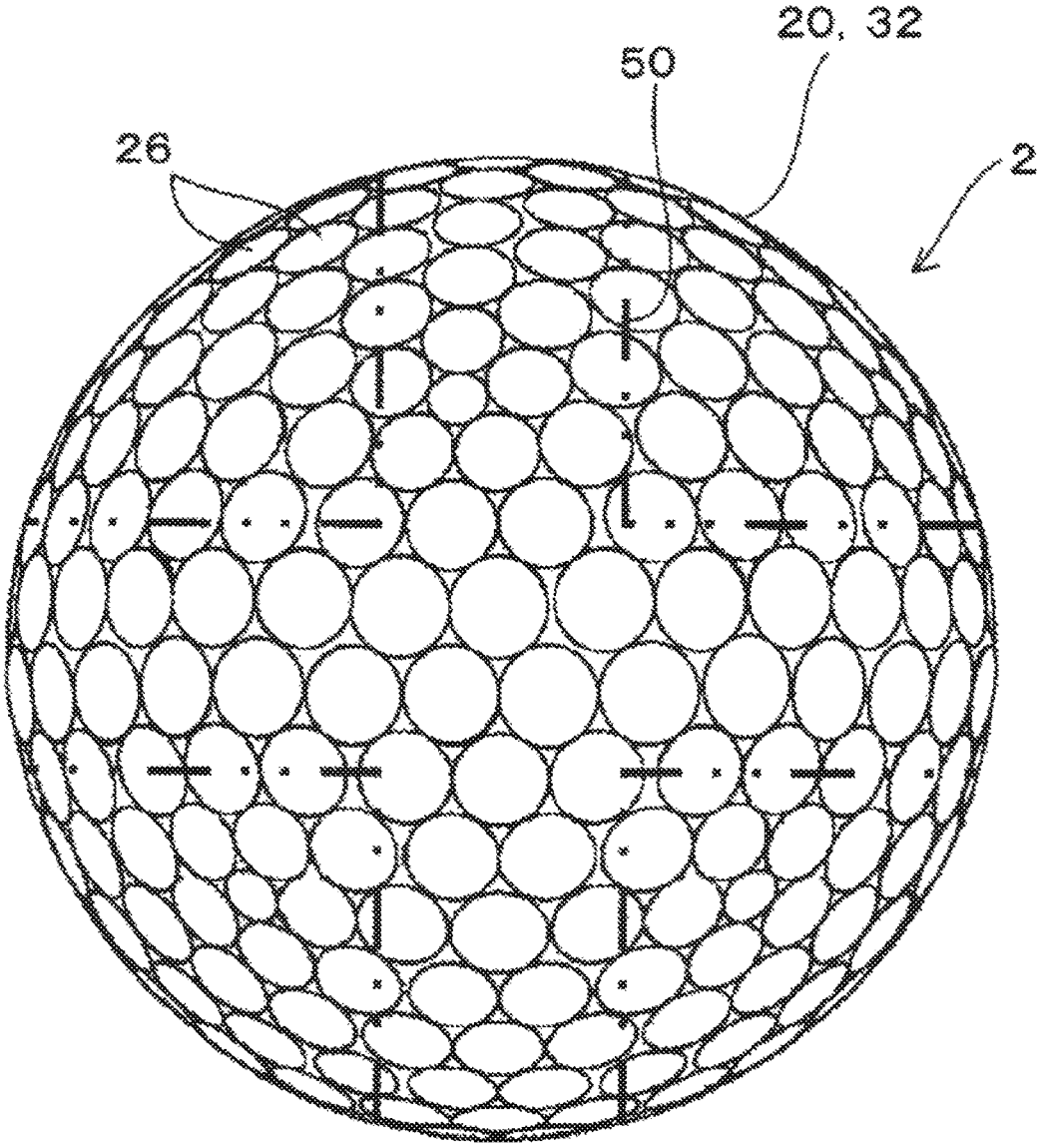
FIG. 37 is a plan view of a ball for a ball game 2 covered with a masking member 50 according to a fifteenth embodiment.
Figure 38:
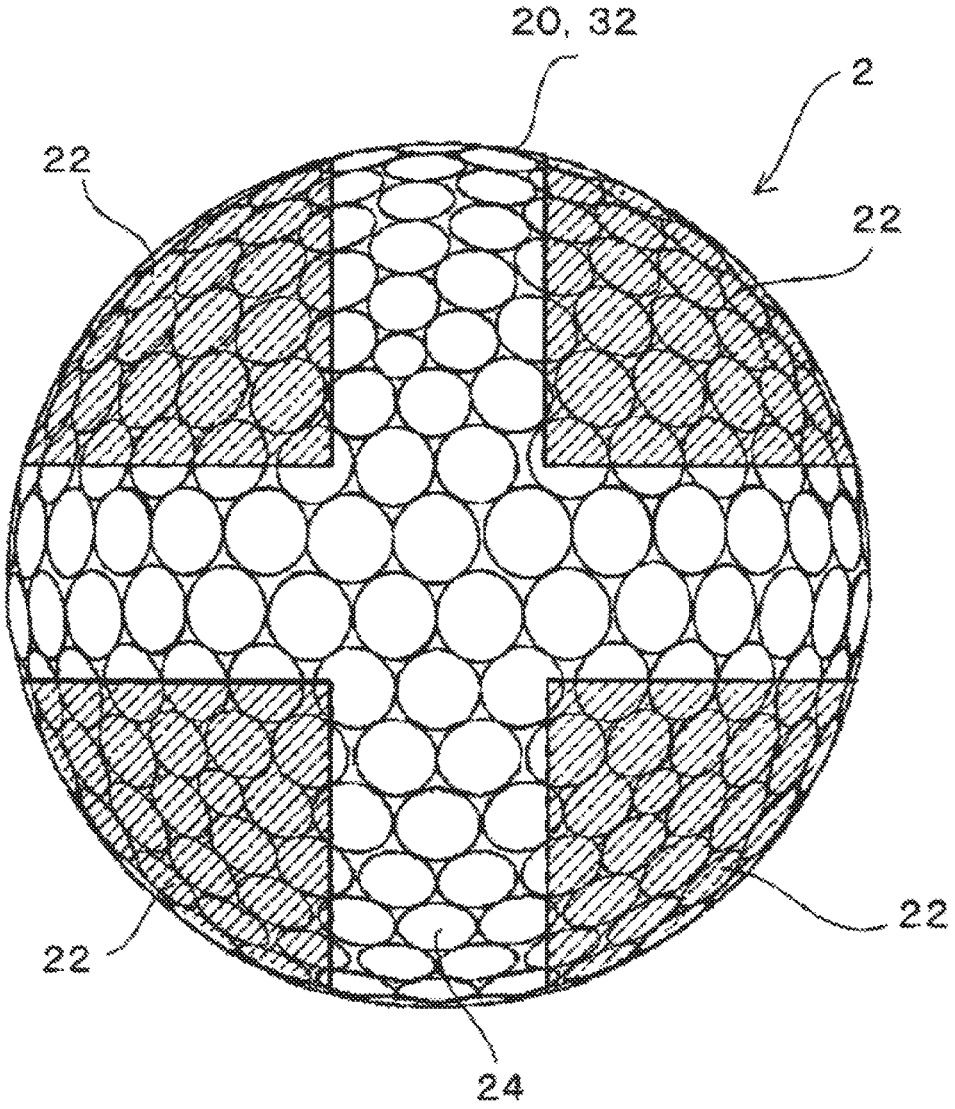
FIG. 38 is a plan view of the ball for a ball game 2 with the first regions 22 being formed according to the fifteenth embodiment.

Specifically, in the fifteenth embodiment, as illustrated in FIG. 37, the deposition of the second material is performed in a state in which a masking member 50 covers portions of the spherical surface corresponding to the second regions 24, and portions corresponding to the first regions 22 are exposed from the masking member 50.

Here, examples that can be used as the masking member 50 include adhesive tapes, resin films that contract due to heat, and the like.

When using a resin film that contracts due to heat, the resin film is adhered to the spherical surface of the spherical body 20 by applying heat after covering areas that correspond to the second regions 24 with the resin film.

The second material is deposited using a deposition device while the masking member 50 is applied. Thereafter, when the masking member 50 is removed from the spherical surface, as illustrated in FIG. 38, a ball for a ball game 2 on which the first regions 22 and the second regions 24 are formed is obtained.

Note that windows that expose the first regions 22 from the masking member 50 may be formed beforehand and the second material may be deposited on the spherical surface of the spherical body 20 exposed from the windows in order to form the first regions 22.

With the fifteenth embodiment described above, the same effects as provided by the first embodiment are provided.

Sixteenth Embodiment

Next, a sixteenth embodiment will be described while referencing FIG. 39.

In the sixteenth embodiment, a case in which a ball for a ball game 2 is a golf ball will be described.

In the sixteenth embodiment, the mold 46 and the masking member 50 are not used, rather the second material is deposited on all regions of the spherical surface including the multiplicity of dimples 26.

Next, the second material is removed from the spherical surface by abrasing the spherical surface.

Figure 39:
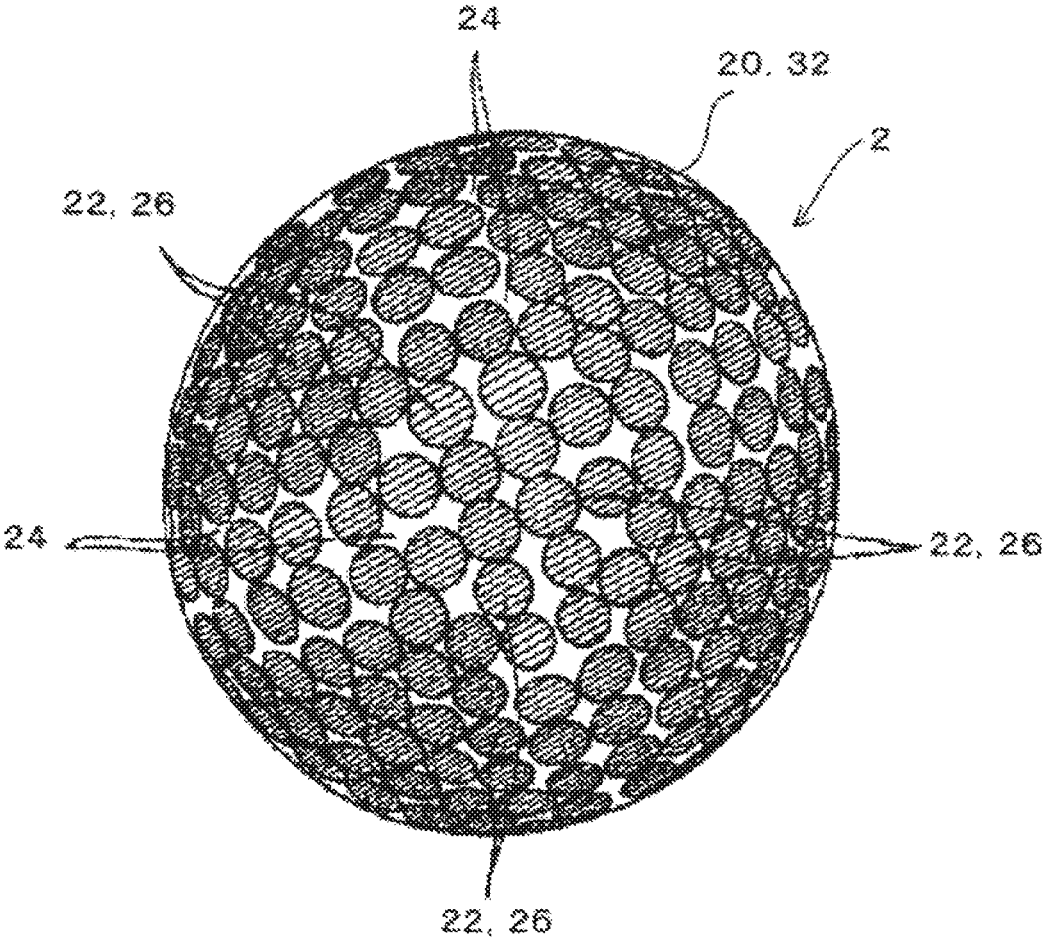
FIG. 39 is a plan view of a ball for a ball game 2 with first regions 22 being formed according to a sixteenth embodiment.

By removing the second material, as illustrated in FIG. 39, the first regions 22 are formed from the second material that remains on the dimples 26, and the second regions 24 are formed from the spherical surface where the second material has been removed.

In other words, the spherical surface having a center of the spherical body 20 as a center is formed from the first material, the second material is deposited via vacuum deposition on all regions of the spherical surface, and the second material is removed from predetermined regions after the deposition. Thereby, the first regions 22 are formed from the second material that remains on the spherical surface, and the second regions 24 are formed from the spherical surface where the second material has been removed.

Specifically, the first regions 22 are formed on the dimples 26 and the second regions 24 are formed on portions of the spherical surface other than where the multiplicity of dimples 26 are formed.

Note that in cases where the ball for a ball game 2 does not have the dimples 26, for example, in the case of a table tennis ball, the first regions 22 and the second regions 24 may be formed by forming the table tennis ball from the first material, depositing the second material on all regions of a surface thereof, and, thereafter, removing portions of the second material via mechanical processing or chemical treating.

It goes without saying that the same effects are provided by the sixteenth embodiment described above that are provided by the fourteenth embodiment, and because the mold 46 and the masking member 50 are not used, this is advantageous from the perspective of reducing costs.

Note that in this embodiment, a case in which the spherical surface having a center of the spherical body 20 as a center is constituted by the surface of the cover layer 32 was described, however the spherical surface of the spherical body 20 may be the surface of the core layer (or the inner surface of the cover layer 32). In this case, it is sufficient that the first regions 22 and the second regions 24 be formed on the surface of the core layer (or the inner surface of the cover layer 32). In summary, the spherical surface of the spherical body 20 may be positioned on the surface of the ball for a ball game (outer surface) or inside the ball for a ball game.

A case in which the spherical surface of the spherical body 20 is positioned inside the ball for a ball game will be described.

A case in which the ball for a ball game 4 is a hard baseball will be described while referencing back to FIG. 20.

The spherical body 20 is formed by a spherical, solid core layer 30 and a cover layer 32 covering the core layer 30. The core layer 30 is constituted by a spherical, solid inside core layer 30A and an outside core layer 30B covering the inside core layer 30A.

The spherical surface of the spherical body 20 may be an outer surface of the inside core layer 30A (an inner surface of the outside core layer 30B) or an outer surface of the outside core layer 30B (an inner surface of the cover layer 32).

Here, it is sufficient that portions covering the spherical surface of the spherical body 20, specifically, the outside core layer 30B and the cover layer 32, be formed from a material that allows passage of radio waves such as, for example, a material that does not contain an electrically conductive substance so that radio waves will be reflected from the first regions 22.

Examples of the material that can be used for the outside core layer 30B include threads such as wool yarn, cotton yarn and the like; or synthetic resin materials such as urethane foam and the like. Examples that can be used for the cover layer 32 include cowhide.

When the first regions 22 and the second regions 24 are formed inside the spherical body 20 as described above, the first regions 22 and the second regions 24 are hidden and do not affect the visual appearance of the ball for a ball game. Thus, the first regions 22 and the second regions 24 can be formed without taking into consideration the design or visual appearance of the first regions 22 and the second regions 24, which is advantageous from the perspective of reducing production costs.

The method of the present technology as described above is not limited to golf balls, and can be applied to a wide variety of balls for ball games including hard baseballs, soft baseballs, and the like.

Seventeenth Embodiment

Figure 40:
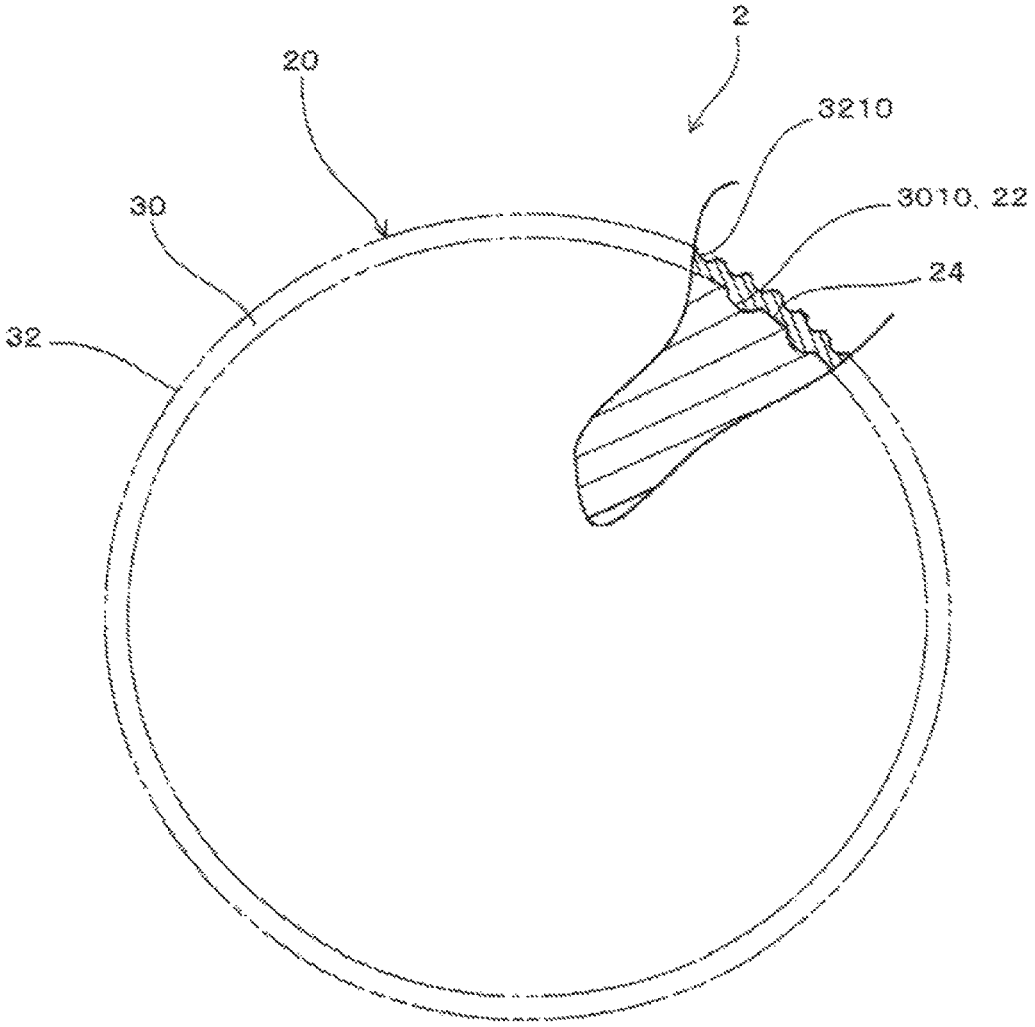
FIG. 40 is a drawing illustrating a ball for a ball game 2 with first regions 22 being formed according to a seventeenth embodiment, in a state where a portion thereof is ruptured.

Next, a seventeenth embodiment will be described while referencing FIG. 40.

In the seventeenth embodiment, a case in which a ball for a ball game 2 is a golf ball will be described.

In the seventeenth embodiment, the spherical body 20 is constituted by a core layer 30 and a cover layer 32 and, as in the sixteenth embodiment, the first regions 22 are formed on dimples 3010 that are formed in the core layer 30.

Specifically, the core layer 30 is spherical and has a surface in which a plurality of the dimples 3010 is formed on the spherical surface thereof.

The cover layer 32 is formed from a material that allows the passage of radio waves, covers the core layer 30, and has a surface on which a different multiplicity of dimples 3210 (different from the plurality of dimples 3010 described above) are formed on the spherical surface thereof. In this embodiment, the spherical surface having a center of the spherical body 20 as a center is a surface of the core layer 30.

A method for manufacturing the golf ball is as follows.

First, a first material and a second material with a radio wave reflectance higher than that of the first material are prepared. In this embodiment, an electrically conductive coating material is used as the second material.

Then, the core layer 30 is formed from the first material.

All regions of the surface of the core layer 30 are covered with the second material by applying the electrically conductive coating material to all regions of the surface of the core layer 30 including the plurality of dimples 3010.

Next, the second material is removed from the spherical surface by abrasing the spherical surface of the core layer 30.

Thereby, the first regions 22 are formed from the second material that remains on the dimples 3010, and the second regions 24 are formed from the spherical surface of the core layer 30 where the second material has been removed.

Thereafter, the cover layer 32 is formed on an outer side of the core layer 30.

As a result, the first regions 22 are formed on the plurality of dimples 3010 of the core layer 30 and the second regions 24 are formed in areas of the spherical surface of the core layer 30 other than where the plurality of dimples 3010 are formed.

It goes without saying that the same effects are provided by the seventeenth embodiment that are provided by the sixteenth embodiment. The first and second regions 22 and 24 are covered by the cover layer 32 and, therefore, the visual appearance thereof can be configured so as to be the same as a regular golf ball, which is advantageous from the perspective of enhancing design.

Note that in this embodiment, all regions of the surface of the core layer 30 are covered with the second material by applying the electrically conductive coating material to all regions of the surface of the core layer 30, but various conventional methods, such as vacuum deposition and the like, can be used as the method for covering all regions of the surface of the core layer 30 with the second material.

The invention claimed is:

1. A ball for a ball game, the ball being a spherical body and comprising:

a spherical core inside the spherical body, the spherical core being a sphere having a center of the spherical body as a center, a spherical cover layer covering the spherical core, the spherical cover layer being a sphere having a center of the spherical body as a center, first and second regions formed on a spherical surface of the spherical core or on a spherical surface of the spherical cover layer;

the first regions are formed of a first material, the first material being an electrically conductive material and having a radio wave reflectance, the first regions each having a diameter of not less than 2 mm and not more than 15 mm, and the second regions are formed of a second material in areas other than where the first regions are formed, the second material being an electrically non-conductive material and having a radio wave reflectance lower than the radio wave reflectance of the first material.

2. The ball for a ball game according to claim 1, wherein three of the first regions are formed, and the three of the first regions are positioned such that imaginary lines connecting the three first regions form an equilateral triangle including a diameter of the spherical body on a plane.

3. The ball for a ball game according to claim 2, wherein the ball for a ball game is a golf ball forming the spherical body, the spherical surface having the center of the spherical body as a center is a surface of the golf ball, the surface of the golf ball is constituted by a spherical surface formed by a multiplicity of dimples, the first regions are formed on the dimples, and the second regions are formed on areas of the spherical surface other than on the multiplicity of dimples.

4. The ball for a ball game according to claim 2, wherein the spherical body is a golf ball, and wherein:

the spherical surface of the spherical core includes a multiplicity of dimples formed thereon; and the spherical surface of the spherical cover layer includes a multiplicity of dimples, separate from said dimples;

the spherical cover layer is made from a material that allows passage of radio waves, the first and second regions are formed on the spherical surface of the spherical core, the first regions are formed on the multiplicity of dimples of the spherical surface of the spherical core, and the second regions are formed on areas of the spherical surface of the spherical core other than on the multiplicity of dimples.

5. The ball for a ball game according to claim 1, wherein the first regions are positioned at vertices of an imaginary regular polyhedron or a semiregular polyhedron such that the vertices are positioned on the spherical surface of the spherical core or on the spherical surface of the spherical cover layer.

6. The ball for a ball game according to claim 5, wherein the ball for a ball game is a golf ball forming the spherical body, the first and second regions are formed on a surface of the golf ball, the surface of the golf ball is constituted by a spherical surface formed by a multiplicity of dimples, the first regions are formed on the dimples, and the second regions are formed on areas of the spherical surface other than on the multiplicity of dimples.

7. The ball for a ball game according to claim 5, wherein the spherical body is a golf ball, and wherein:

the spherical surface of the spherical core includes a multiplicity of dimples formed thereon; and the spherical surface of the spherical cover layer includes a multiplicity of dimples, separate from said dimples;

the spherical cover layer is made from a material that allows passage of radio waves, the first and second regions are formed on the spherical surface of the spherical core, the first regions are formed on the multiplicity of dimples of the spherical surface of the spherical core, and the second regions are formed on areas of the spherical surface of the spherical core other than on the multiplicity of dimples.

8. The ball for a ball game according to claim 1, wherein the first regions form a circle having a diameter that is not less than 2 mm and not more than 15 mm, or a regular polygon having a diameter of an inscribed circle that is not less than 2 mm and not more than 15 mm.

9. The ball for a ball game according to claim 8, wherein the ball for a ball game is a golf ball forming the spherical body, the first and second regions are formed on a surface of the golf ball, the surface of the golf ball is constituted by a spherical surface formed by a multiplicity of dimples, the first regions are formed on the dimples, and the second regions are formed on areas of the spherical surface other than on the multiplicity of dimples.

10. The ball for a ball game according to claim 8, wherein the spherical body is a golf ball, and wherein:

the spherical surface of the spherical core includes a multiplicity of dimples formed thereon; and the spherical surface of the spherical cover layer includes a multiplicity of dimples, separate from said dimples;

the spherical cover layer is made from a material that allows passage of radio waves, the first and second regions are formed on the spherical surface of the spherical core, the first regions are formed on the multiplicity of dimples of the spherical surface of the spherical core, and the second regions are formed on areas of the spherical surface of the spherical core other than on the multiplicity of dimples.

11. The ball for a ball game according to claim 1, wherein:

a surface resistance of the first regions is not more than 130 Ω/sq, the ball for a ball game is a hard ball for baseball, the spherical body comprises a spherical and solid core layer as the spherical core, and the cover layer that covers the solid core layer, the first and second regions are formed on an outer surface of the cover layer, the cover layer is constituted by a plurality of outer coverings and electrically conductive stitching for stitching together the outer coverings, the first regions are constituted by the stitching, and the second region is constituted by the outer coverings.

12. The ball for a ball game according to claim 1, wherein:

a surface resistance of the first regions is not more than 130 Ω/sq, the ball for a ball game is a soft ball for baseball, the spherical body comprises a spherical and hollow core layer as the spherical core, and the cover layer that covers the core layer, the first and second regions are formed on an outer surface of the cover layer, the cover layer comprises a band region formed extending band-like along a surface of the spherical body and a plurality of recesses and protrusions formed throughout an overall length of the band region, wherein a reflecting portion having radio wave reflectability is formed in the recesses and/or the protrusions that constitute the plurality of recesses and protrusions, the first region is constituted by the reflecting portion, and the second region is constituted by an area of the cover layer other than the reflecting portion.

* * * * *